United States Patent [19]

O'Connell

[11] 4,352,100

[45] Sep. 28, 1982

[54] IMAGE FORMATTING APPARATUS FOR VISUAL DISPLAY

[75] Inventor: Stephen B. O'Connell, Trumansburg, N.Y.

[73] Assignee: NCR Corporation, Dayton, Ohio

[21] Appl. No.: 210,085

[22] Filed: Nov. 24, 1980

[51] Int. Cl.[3] ..... G09G 1/16

[52] U.S. Cl. ..... 340/723; 340/750; 340/798

[58] Field of Search ..... 340/709, 735, 723, 789, 340/798, 799, 802, 734, 744, 748, 750

[56] References Cited

U.S. PATENT DOCUMENTS

| | | | |
|---|---|---|---|
| 2,595,646 | 5/1952 | Doba, Jr. et al. | 340/736 |
| 3,895,374 | 7/1975 | Williams | 340/723 |
| 4,121,283 | 10/1978 | Walker | 340/709 |
| 4,149,184 | 4/1979 | Giddings et al. | 340/730 |
| 4,167,729 | 9/1979 | Christenson et al. | 340/709 |
| 4,228,430 | 10/1980 | Iwamura et al. | 340/735 |

*Primary Examiner*—Marshall M. Curtis

*Attorney, Agent, or Firm*—J. T. Cavender; Stephen F. Jewett; Edward Dugas

[57] ABSTRACT

Image formatting apparatus for a visual display where image data is stored in an addressable memory and is read out in selectable format with masking of desired areas of the display screen being controllable so as to change image contrast and/or to provide masked borders around selected images.

5 Claims, 33 Drawing Figures

IMAGE FORMATTING APPARATUS FOR VISUAL DISPLAY

BACKGROUND OF THE INVENTION

The present invention is directed to a visual display system and more particularly to a visual display system which allows the positioning of selected portions of multiple images on a visual display unit, for example, a CRT display. Provisions are made for generating blanking areas on the screen which may serve as a background or as a border for the images. The state of the prior art of image editing and dynamic viewing of stored digital images is represented by U.S. Pat. No. 3,976,982 entitled Apparatus for Image Manipulation and by U.S. Pat. No. 4,070,710 entitled Raster Scan Display Apparatus For Dynamic Viewing of Image Elements Stored in a Random Access Memory Array. The present system finds particular utility in the banking area where it is desirable to compare the signature appearing on a check or other type of document with that contained on a signature card for purposes of verifying the authenticity of the signature. In the past, such verification has been made by clerks examining the actual check against the card and making a decision based on a comparison of the physical documents. In electronic banking, the checks themselves are not transmitted to the customer but are maintained in a central document storage file. The physical checks are scanned by an optical scanner to convert the image of the check into electrical equivalents, generally pulses. Through various electrical signal processes the electrical image is compressed to eliminate superfluous and/or redundant portions. Compression of the electrical signal is desirable in order to transmit the largest number of images in the shortest possible time without loss in image quality. The compressed image, prior to display, is decompressed and directed to an image display device such as a CRT display. At the issuing bank a teller may review the CRT display of the check and compare it against a signature card to determine the validity of the signature. The signature card may also be displayed on the CRT if so desired. In viewing large quantities of checks, during the normal work day, the background of the image display may cause fatigue in the viewer. Therefore, it is highly desirable to blank the image display in the area where images do not appear in order to minimize the harshness of visual contrast.

SUMMARY OF THE INVENTION

In the preferred embodiment there is provided a random access memory for storing data bits representing the images to be displayed, and having a capacity at least equivalent to the size of the images that are to be displayed. Addressing means are provided for addressing selected portions of the memory so as to display the images or portions of the images represented by the data bits stored at the addressed portions of memory. Further, addressing means are provided for selecting the position on the image display device at which the image data is to appear. A blanking means inputs blanking data to the display whenever image data is not to be displayed. The capability of selectively addressing the memory provides the viewer with the versatility of being able to view either the entire image or images stored in memory or in viewing one or more segments of one image and in simultaneously viewing portions of other images which may be stored in the memory.

From the foregoing it can be seen that it is a primary object of the present invention to provide an improved system for displaying stored images.

It is another object of the present invention to provide a display system wherein multiple images may be displayed against a selectable background.

It is still a further object of the present invention to provide a display system wherein segments of a memory stored image may be displayed.

These and other objects of the present invention will become more apparent when taken in conjunction with the following description and drawings which drawings form a part of the present application and wherein like characters indicate like parts.

DESCRIPTION OF THE PREFERRED EMBODIMENTS OF THE INVENTION

Figure 1A:
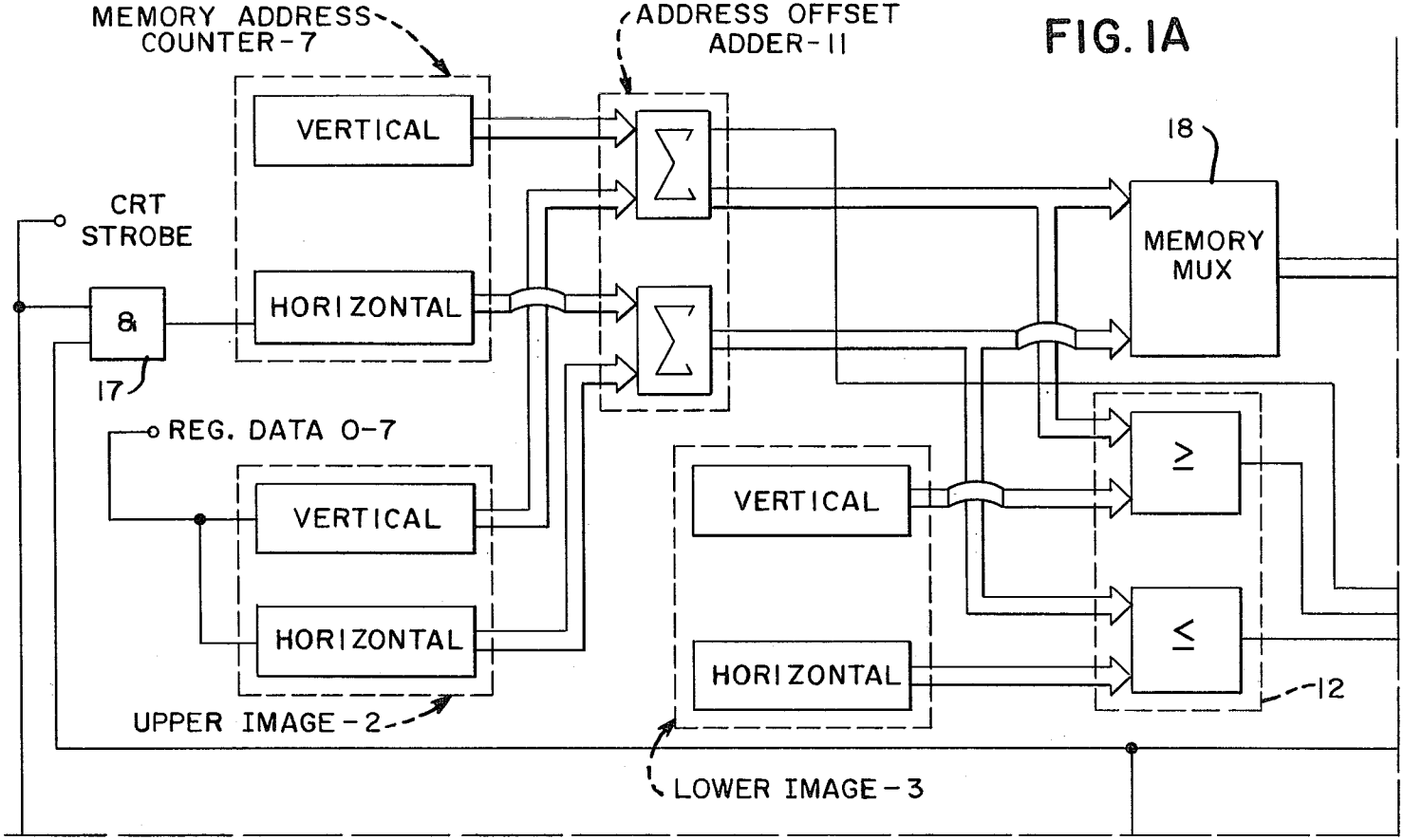
FIGS. 1A, 1B and 1C illustrate in electrical block diagram form the preferred embodiment of the present invention.
Figure 1B:
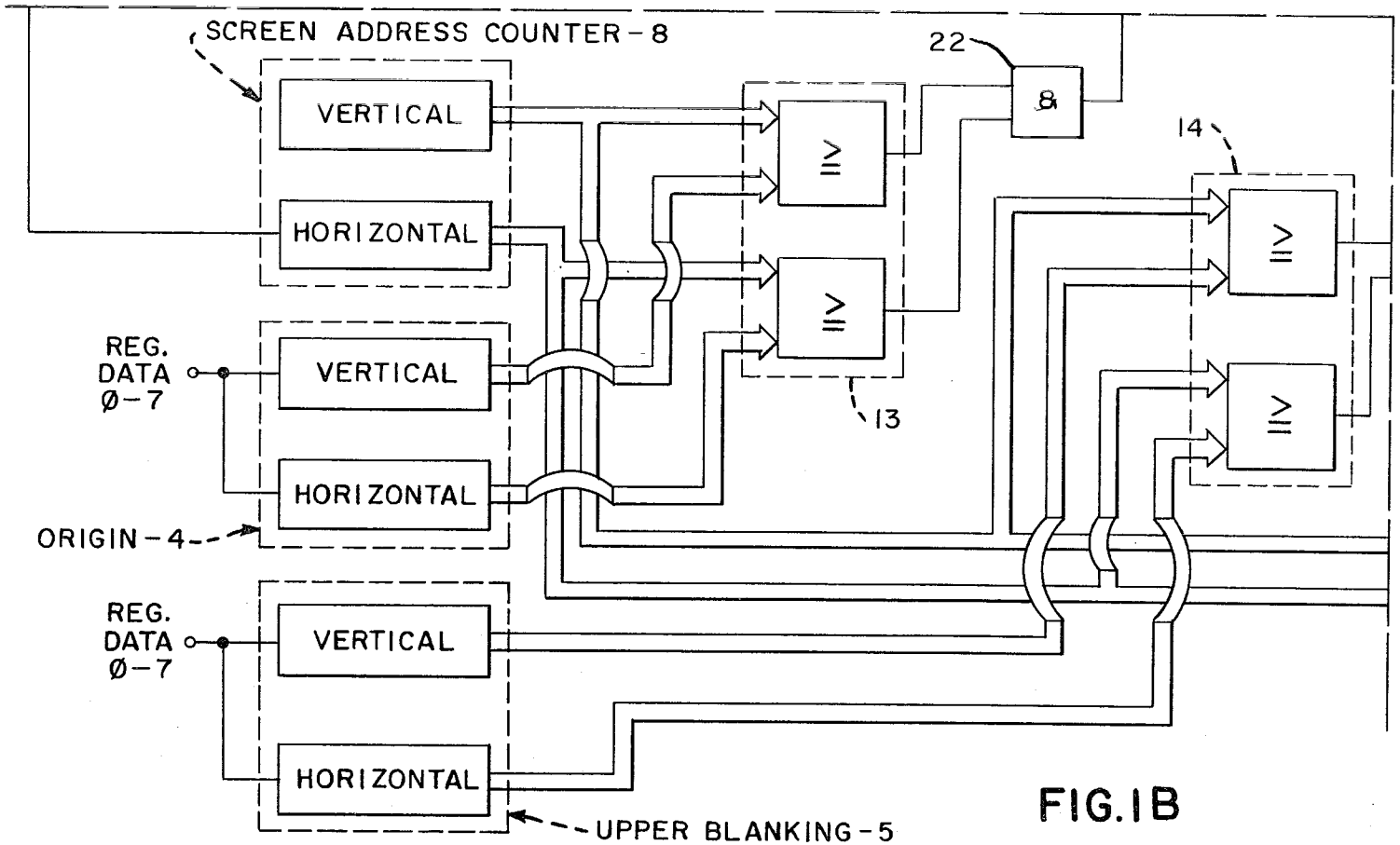
Figure 1C:
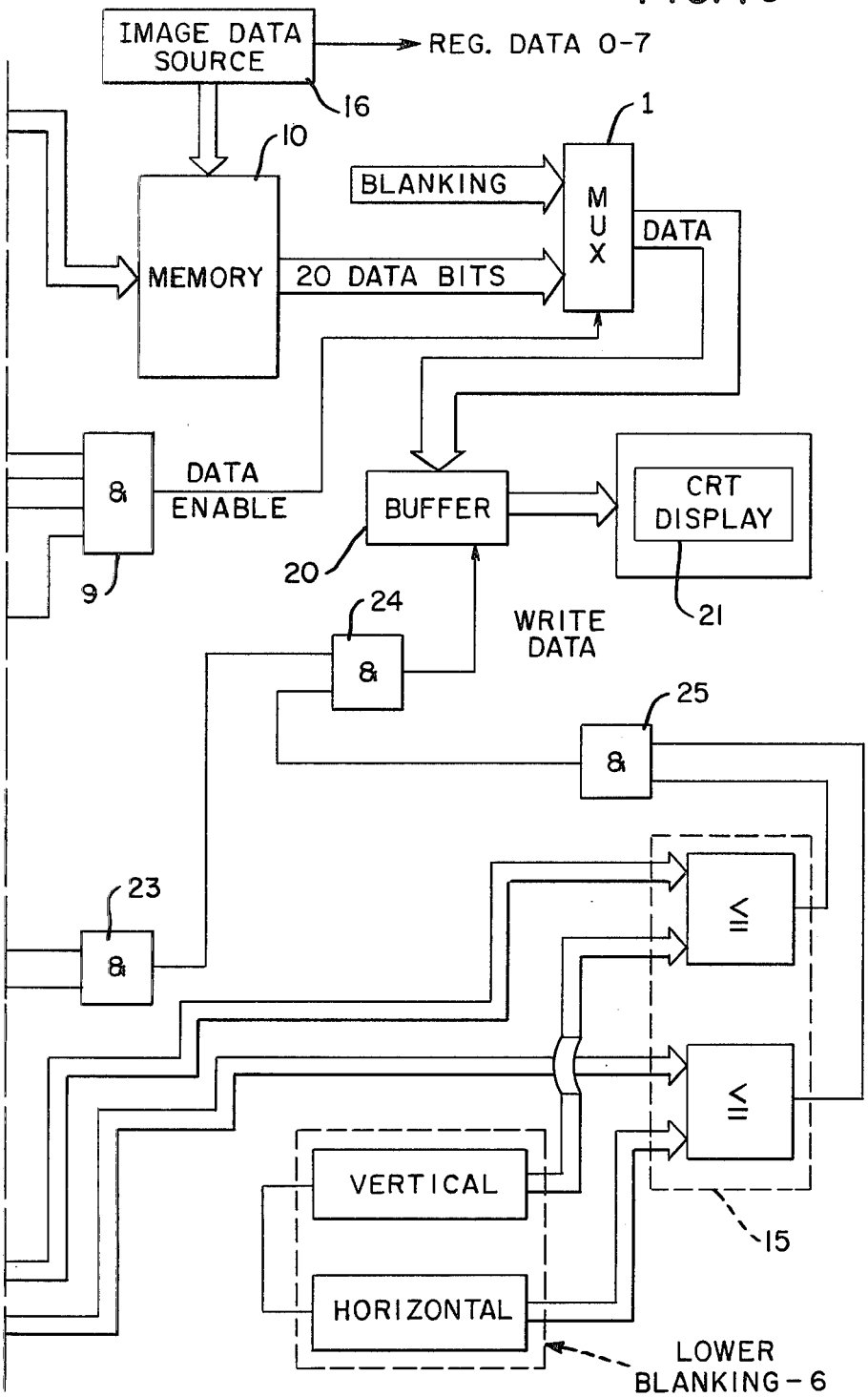
Figure 2:
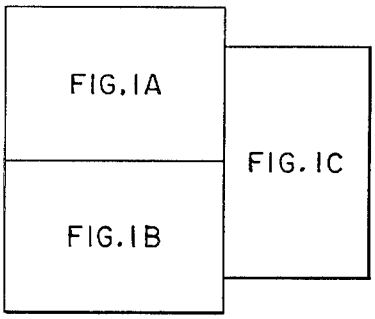
FIG. 2 is a map illustrating the positioning of the drawings of FIGS. 1A, 1B and 1C.

Referring to FIGS. 1A, 1B and 1C and to the map of FIG. 2, a memory 10 of the addressable type is adapted to receive decompressed image data from a data source 16 and to store the data at addressable locations. In the preferred embodiment of the invention the image data is loaded in a specific format. The specific format is that, in increasing addressing values the image is justified to the bottom right hand corner of the memory. In the preferred embodiment of the invention a CRT display unit 21 was utilized to visually create the images. The CRT utilized had a screening size which was 1024 lines by 1280 dots. The dots were orientated vertically on the screen and the lines horizontally. Each data word stored in the memory was 20 bits wide such that if you were to divide the 1280 dots for the vertical height of the screen by 20 you come up with the number 62 which provides you with 64 discrete locations vertically on the screen where you can place or commence to place an image. Because the preferred embodiment of the invention is utilized in a check verification system the images that are stored in the memory are those taken from checks and from, for example, the signature cards of individuals that have allegedly signed the corresponding checks. The digital image of the check is obtained by scanning optically the physical check and by converting the electro-optical scan into digital signals which signals may then be stored so as to represent the image of the check when recreated utilizing this system. The techniques associated with lifting the image from a check and converting the images into compressed and decompressed digital data are considered to be state of the art and are not herein disclosed for purposes of clarity. The memory 10 is addressed by means of a memory address counter 7 which counts clock pulses emanating from the output of an AND gate 17. The counter 7 is continuously cycled through its count in synchronism with the clock signals. The memory address counter 7 is divided into two sections. The first providing an output count corresponding to a vertical five bits and the second providing an output count corresponding to a horizontal ten bits. An address offset adder 11 sums an offset address to the count from the memory address counter to establish the upper address of the image that will be unloaded from the memory 10. The offset signals are generated in an upper image register 2. Selection of the starting or offsetting address can be by way of software control activating logic circuits which in turn will establish the states of various ones of the upper image address register stages. A memory mux 18 multiplexes the address bits from the address offset adder 11 to provide all of the addresses for memory 10. A lower image address register 3 identical in construction to the upper image address register 2 provides to a comparator 12 output bits corresponding to the address in memory which is the last address where read out of image data is to occur. Comparator 12 receives the address offset adder 11 output bits and compares these bits on a one to one basis with the bits from a lower image address register 3. When a comparison occurs enabling signals are forwarded to an AND circuit 9. The AND circuit 9 outputs a DATA ENABLE signal to a multiplexer 1 to enable data to pass from the memory 10 through multiplexer 1 to a screen buffer 20 when all inputs to the AND circuit 9 are enabled. The multiplexer 1 receives the image data consisting of 20 data bits from the memory 10 along with blanking signals. When multiplexer 1 is not outputting image data it is providing blanking signals to the screen buffer 20 as long as the DATA ENABLE signal is present. The image and blanking data stored in screen buffer 20 is outputted to the CRT display 21 when a WRITE DATA signal is received.

An image origin register 4 is adapted to provide address bits corresponding to the origin (start position) on the screen of the CRT display 21 where the image data is going to be shown. The image origin register 4 is formed in two sections a vertical section which is assigned six bits of address data and the horizontal section which is assigned ten bits of address data. A screen address counter 8 having as an input the CRT strobing or clock signal provides address bits at its output corresponding to the address of the screen of the CRT display where data may be presently displayed. The screen address bits along with the address bits from the image origin register 4 are directed to the inputs of comparator 13 where corresponding like bits are compared and upon achieving a total coincidence an output is provided to an enabling input of an AND gate 22. When AND gate 22 receives all enabling signals it provides a gating signal to AND gates 9 and 17. An upper blanking register 5 and a lower blanking register 6 provide address bits corresponding to selected blanking areas for the CRT display to a comparator 14 and a comparator 15 respectively. The inputs to registers 4, 5 and 6 may be by way of software, as was previously indicated with respect to the description of registers 2 and 3. The comparator circuit 14 receives as its inputs the outputs from the blanking register 5 and from the screen address counter 8. With a correspondence in the signals present at its inputs comparator 14 outputs an enabling signal to an input of an AND gate 23. The AND gate 23 when enabled provides a gating signal to an input of an AND gate 24. Comparator 15 compares the signals emanating from the screen address counter 8 and the lower blanking register 6 and upon coincidence provides an activating signal to the inputs to AND gate 25 which in turn provides an activating signal to the other input of AND gate 24. The appearance of an enabling or activating signal and a gating signal at the input of AND gate 24 causes a WRITE DATA enabling signal to appear at the output of AND gate 24 which signal is directed to the write control logic of the screen buffer 20. The enbling signal to buffer 20 causes the serial write of the data stored in the memory 10 into the screen buffer 20 and the simultaneous displaying of the data onto the CRT display 21. DATA will continue to be written onto the screen buffer 20 as long as the output from the AND gate 24 remains enabling and as long as the level of the signals on the inputs of AND gate 9 are enabling. When conditions fall outside of the address range indicated by either the upper image address register 2 or the lower image address register 3 then blanking data as opposed to image data is outputted from multiplexer 1. When conditions fall outside of the address range specified by either the upper blanking register 5 or the lower blanking register 6 neither data nor blanking information is forwarded to the screen buffer 20.

Figure 3:
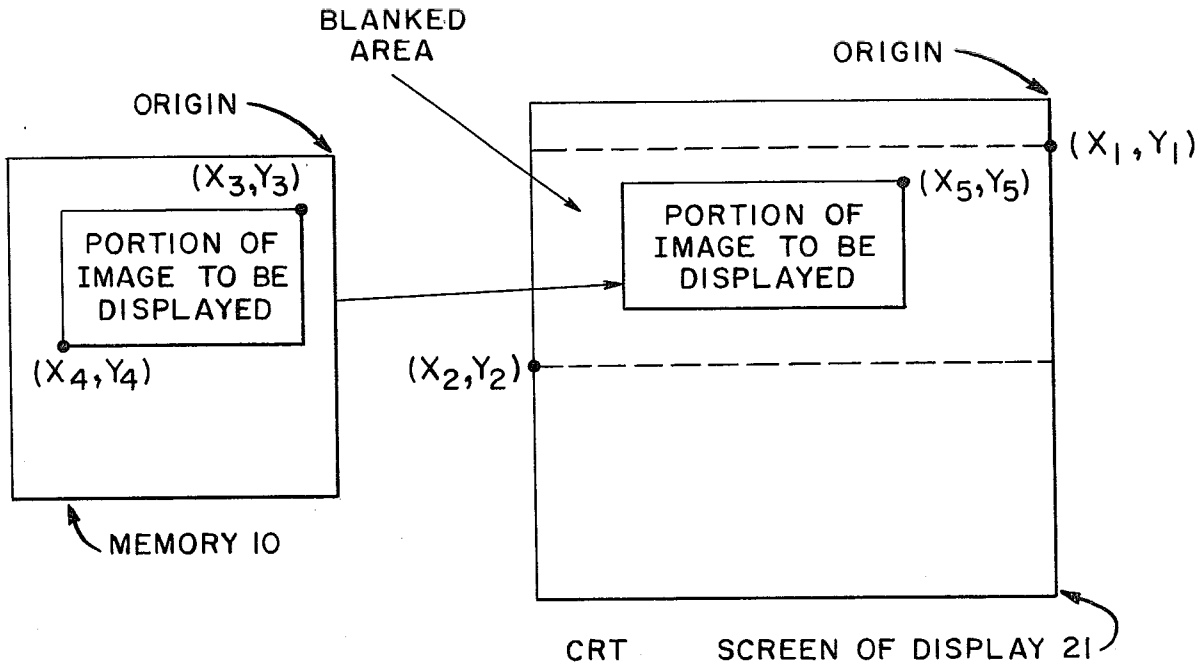
FIG. 3 illustrates the positioning of an image in memory vs. its positioning on a display screen.

Referring to FIG. 3 the screen formatting for an image has the following coordinates:

| | | |
|---|---|---|
| 1. | $(X_1, Y_1)$ $(X_2, Y_2)$ | Rectangular area on CRT Display screen allocated to an image to be blanked. |
| 2. | $(X_3, Y_3)$ $(X_4, Y_4)$ | Rectangular area designating the area of the transmitted image to be displayed. Coordinates reference Memory 10. |
| 3. | $(X_5, Y_5)$ | Origin coordinates representing the position on the CRT display screen where the top right corner of the area of the image to be displayed. Coordinates reference screen buffer 20. |

Ten subfunctions are defined to control the loading of these coordinates.

1. $(X_1, Y_1)$ The two subfunctions used to load this pair of coordinates are LOAD UBR "A" and LOAD UBR "B" (UBR = UPPER BLANKING REGISTER). The X values range from 0 thru 1023, requiring 10 bits while the Y values range from 0 thru 63, requiring 6 bits. Word structure for loading these coordinates will be:

LOAD UBR "A" XXYY YYYY
- Low order Y bit
- High order Y bit
- Low order X bit

LOAD UBR "B" XXXX XXXX
- High order X bit

2. $(X_2, Y_2)$ The two subfunctions used to load this pair of coordinates are LOAD LBR "A" and LOAD LBR "B" (LBR = LOWER BLANKING REGISTER). The X values range from 0 thru 1023, requiring 10 bits, while the Y values range from 0 thru 63, -continued requiring 6 bits. Word structure for loading these coordinates will be:

LOAD UBR "A" XXYY YYYY
- Low order Y bit
- High order Y bit
- Low order X bit

LOAD UBR "B" XXXX XXXX
- High order X bit 3. ($X_3$, $Y_3$) The two subfunctions used to load this pair of coordinates are LOAD UIR "A" and LOAD UIR "B" (UIR = UPPER IMAGE REGISTER). The X values range from 0 thru 1023, requiring 10 bits, while the Y values range from 0 thru 31, requiring 5 bits. Word structure for loading these coordinates will be:

LOAD UIR "A" XXZY YYYY
- Low order Y bit
- High order Y bit
- Not used
- Low order X bit LOAD UIR "B" XXXX XXXX
- High order X bit 4. ($X_4$, $Y_4$) The two subfunctions used to load this pair of coordinates are LOAD LIR "A" and LOAD LIR "B" (LIR = LOWER IMAGE REGISTER). The X values range from 0 thru 1023, requiring 10 bits, while the Y values range from 0 thru 31, requiring 5 bits. Word structure for loading these coordinates will be:

LOAD LIR "A" XXZY YYYY
- Low order Y bit
- High order Y bit
- Not used
- Low order X bit LOAD LIR "B" XXXX XXXX
- High order X bit 5. ($X_5$, $Y_5$) The two subfunctions used to load this pair of coordinates are LOAD IOR "A" and LOAD IOR "B" (IOR = IMAGE ORIGIN REGISTER). The X values range from 0 thru 1023 requiring 10 bits, while the Y values range from 0 to 63, requiring 6 bits. Word structure for loading these coordinates will be:

LOAD IOR "A" XXYY YYYY
- Low order Y bit
- High order Y bit
- Low order X bit

LOAD IOR "B" XXXX XXXX
- High order X bit

Figure 4:
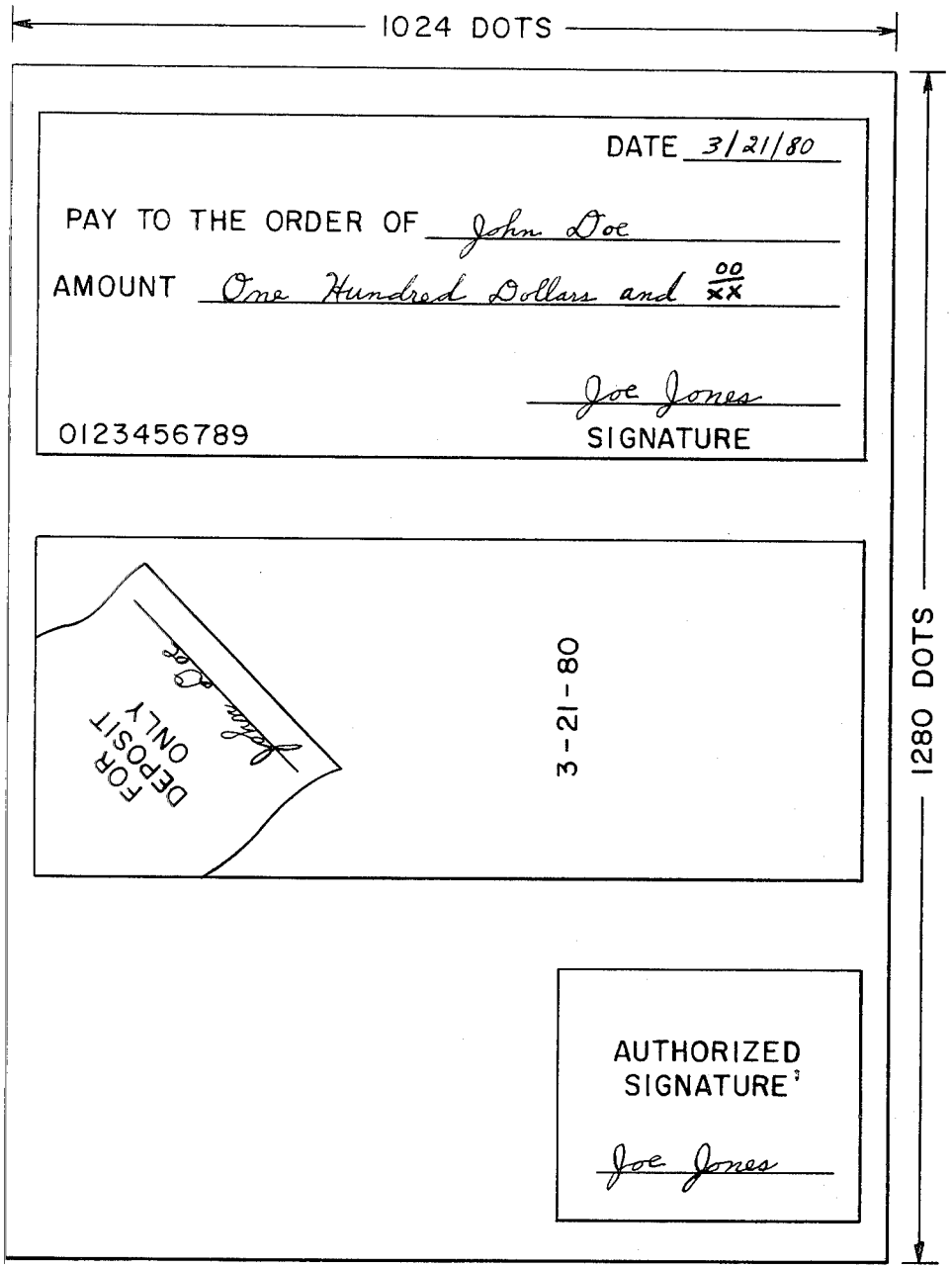
FIG. 4 illustrates a typical group of display images.

Referring to FIG. 4, the CRT display screen is illustrated having three images displayed, the front and back of a check and the authorization card with signature. As previously discussed, any desired number of images may be displayed limited only by the size of the display screen and the memory for storing the images.

Figure 5:
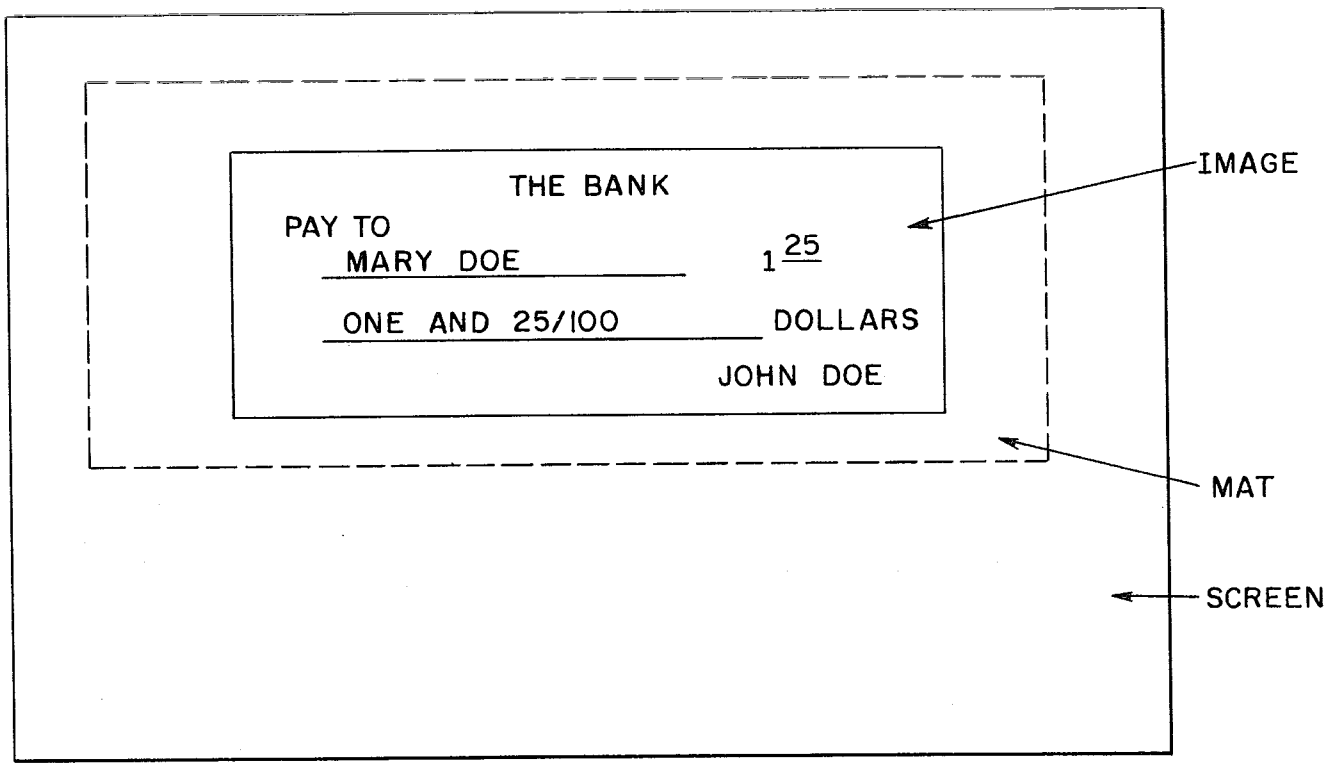
FIG. 5 illustrates the positioning of a mat around an image displayed on a display screen.

In FIG. 5 the display screen is shown with one image and a blanking mat indicated by (dashed lines). The mat image is selectable by adjusting the upper and lower blanking registers.

Figure 7:
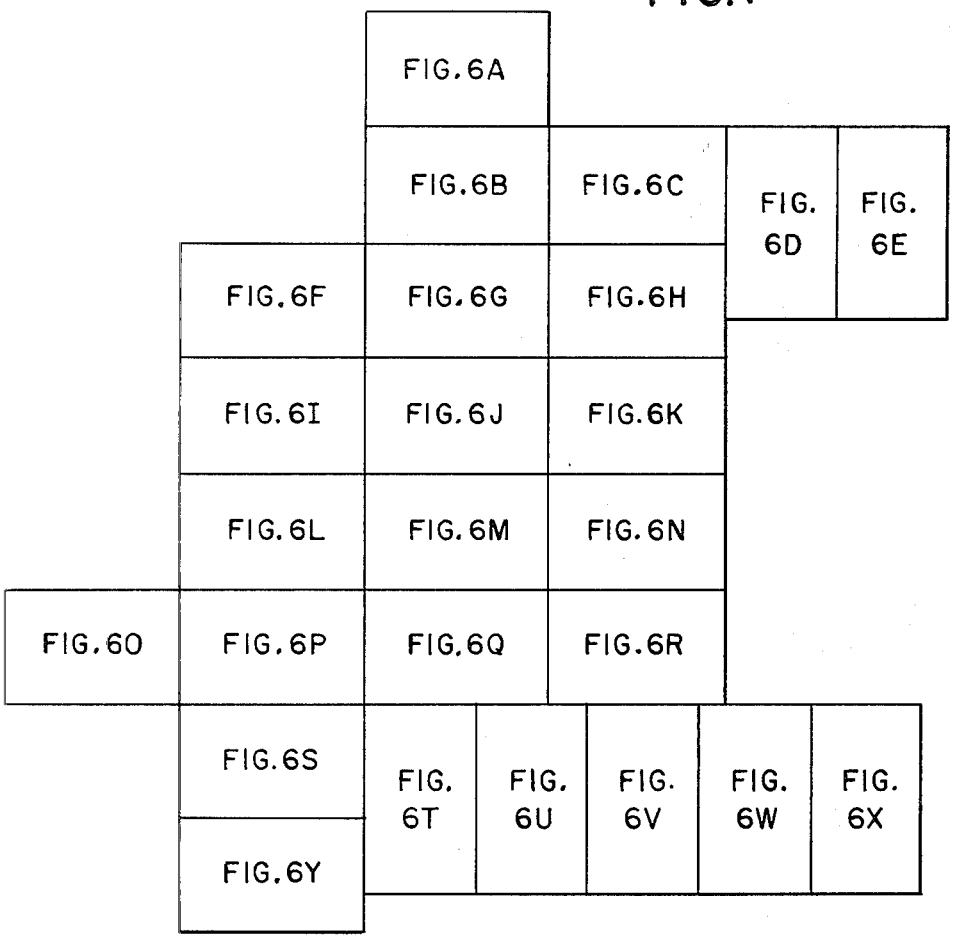
FIG. 7 is a map illustrating the positioning of the drawings of FIGS. 6A through 6Y.
Figure 6A:
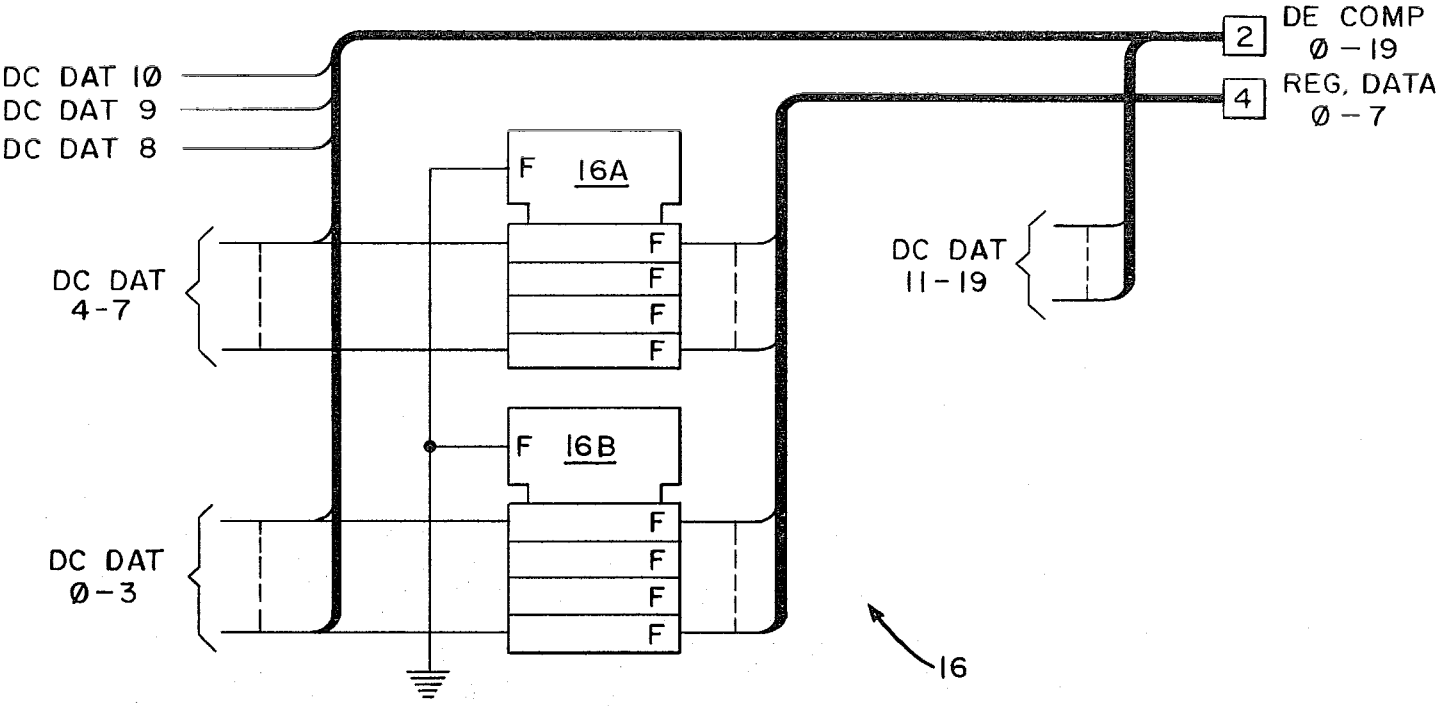
FIGS. 6A through 6Y are electrical schematic diagrams of the invention embodiment illustrated in FIGS. 1A, 1B and 1C.
Figure 6B:
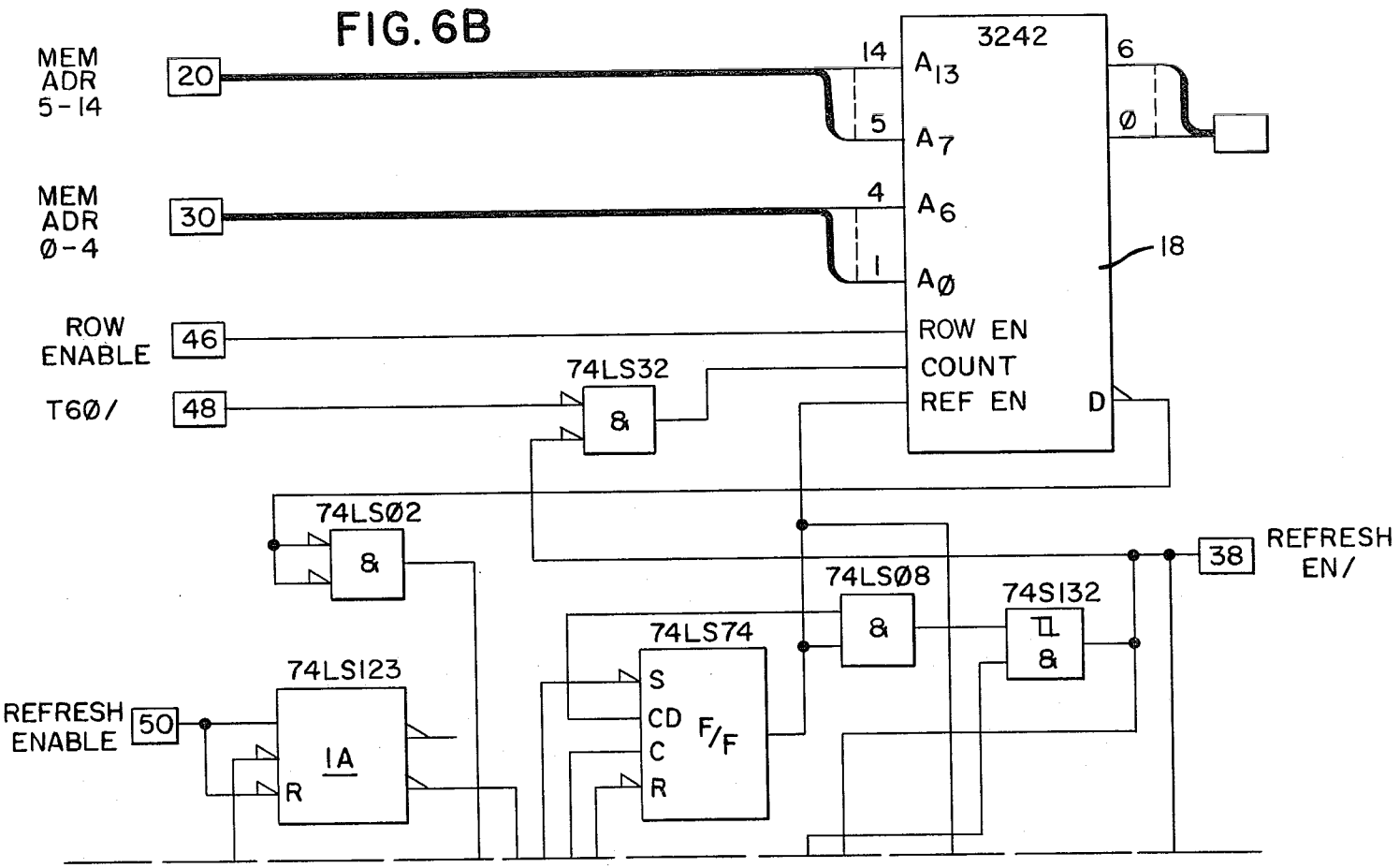
Figure 6C:
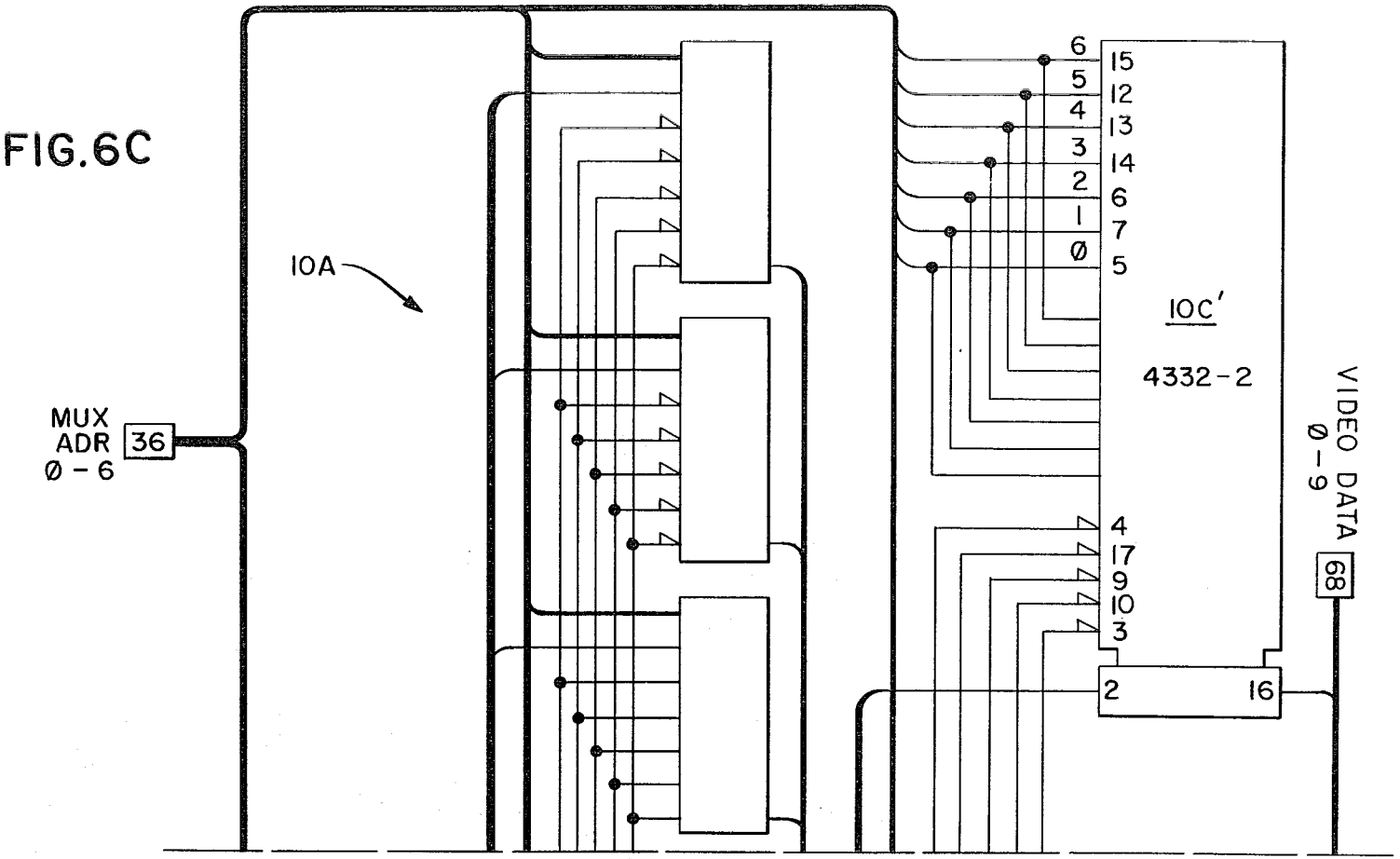
Figure 6D:
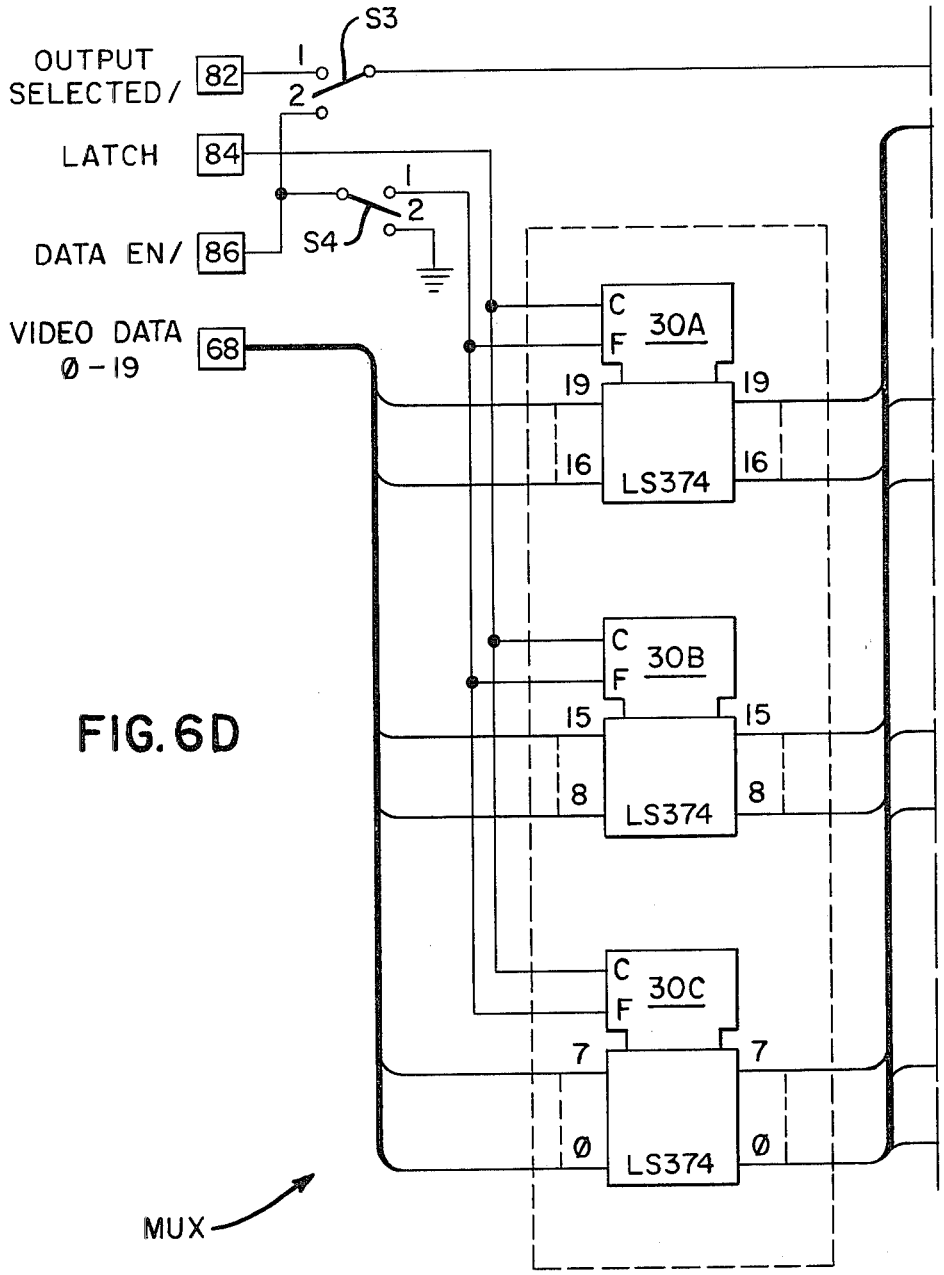
Figure 6E:
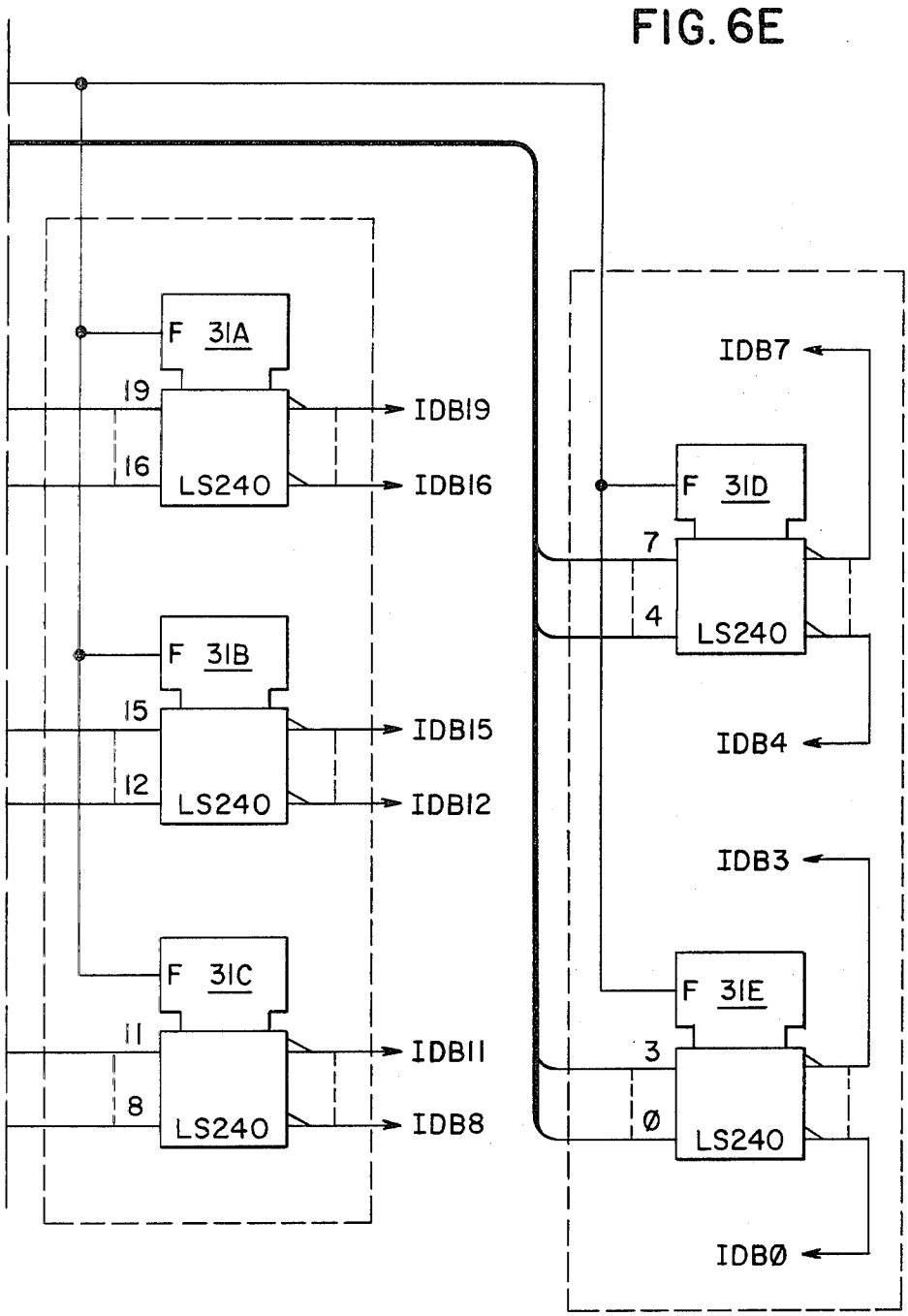
Figure 6F:
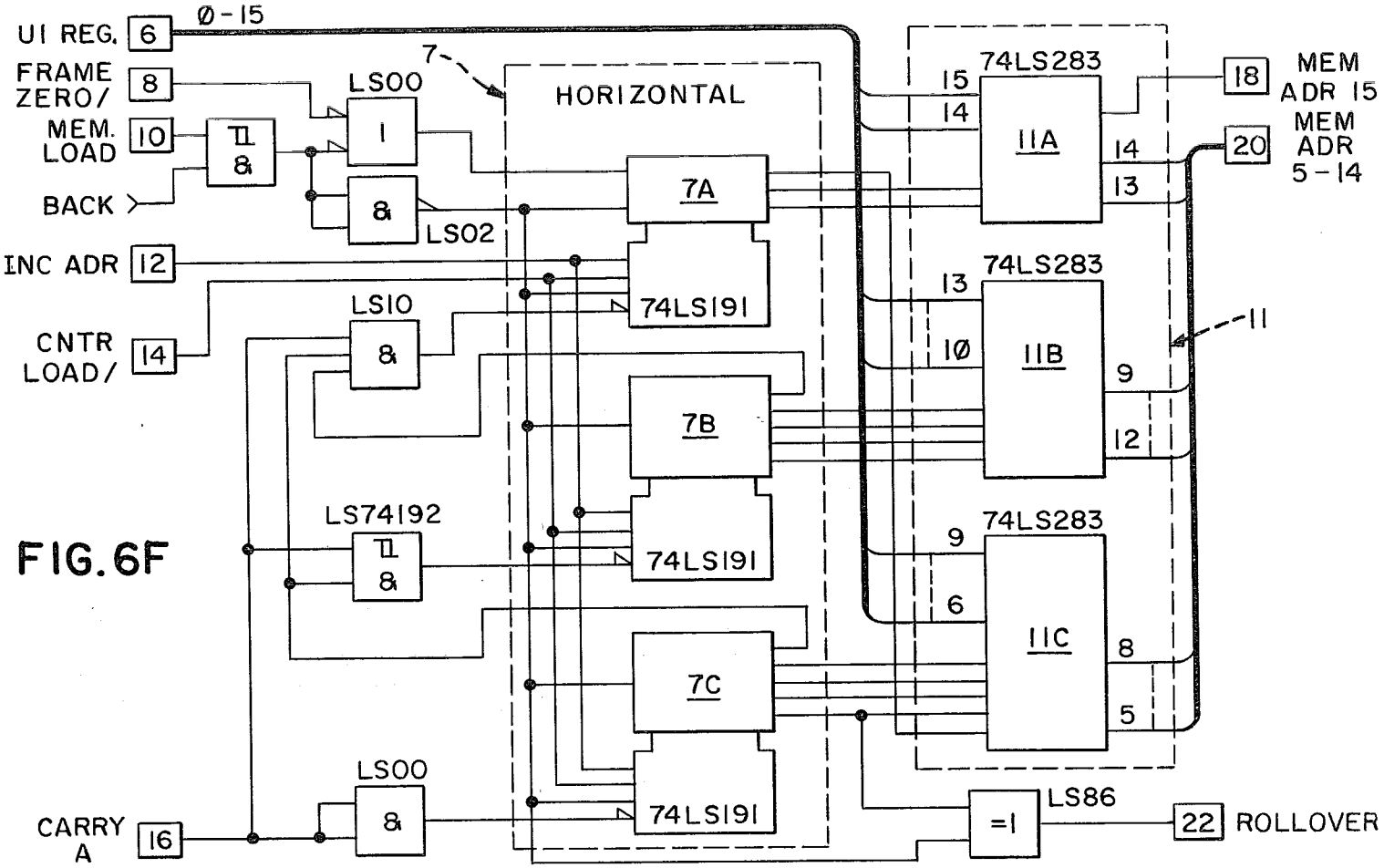
Figure 6G:
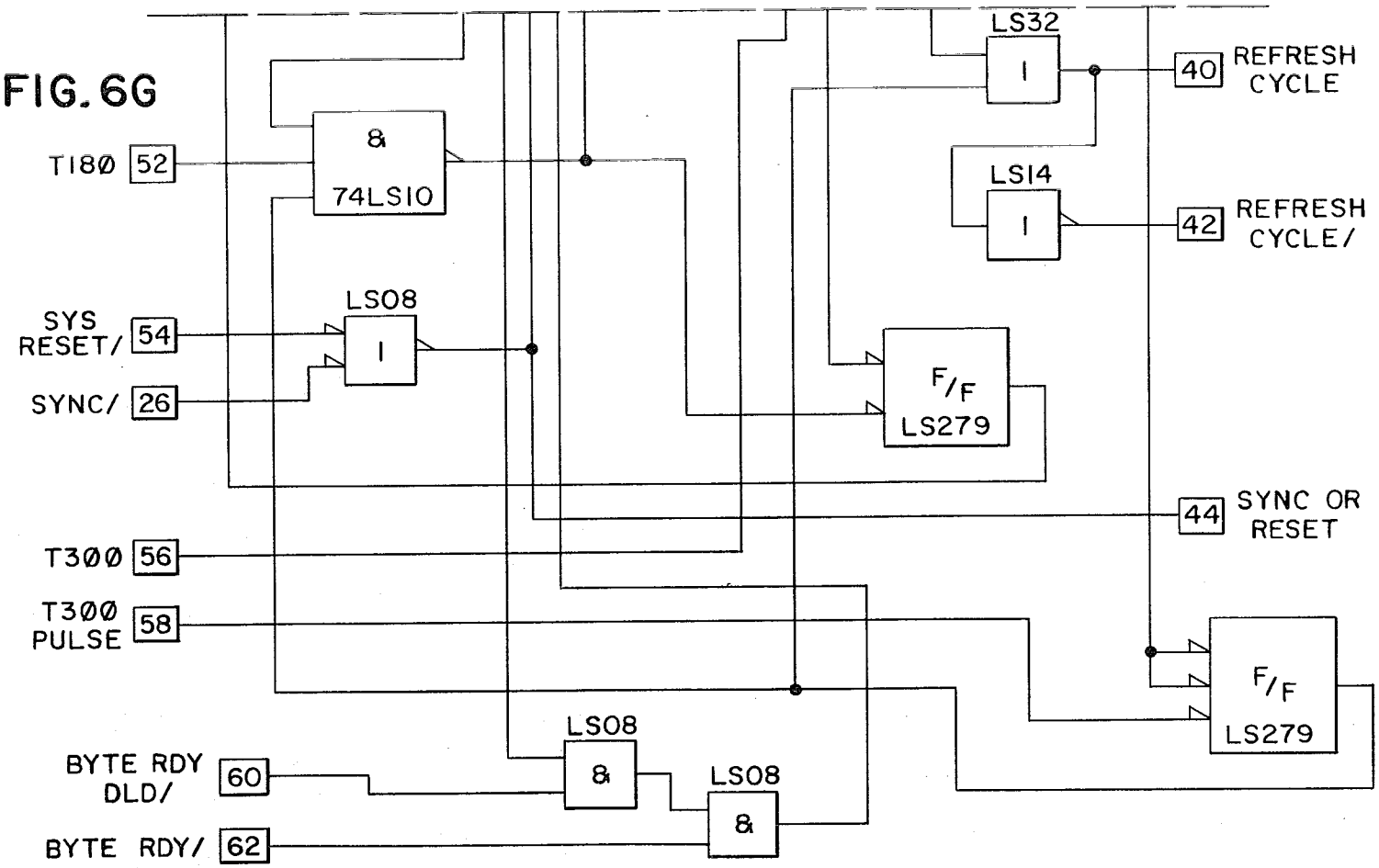
Figure 6H:
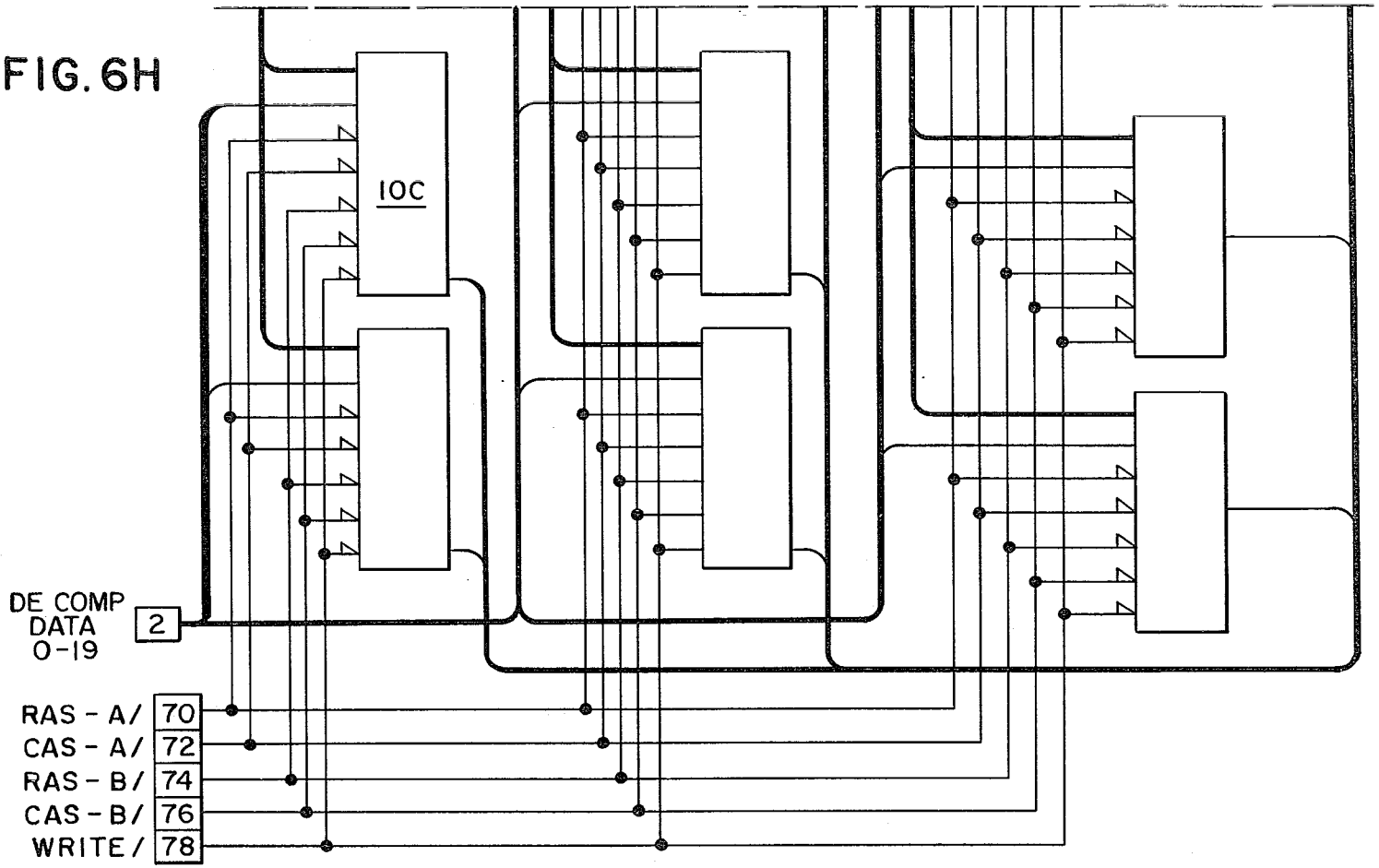
Figure 6I:
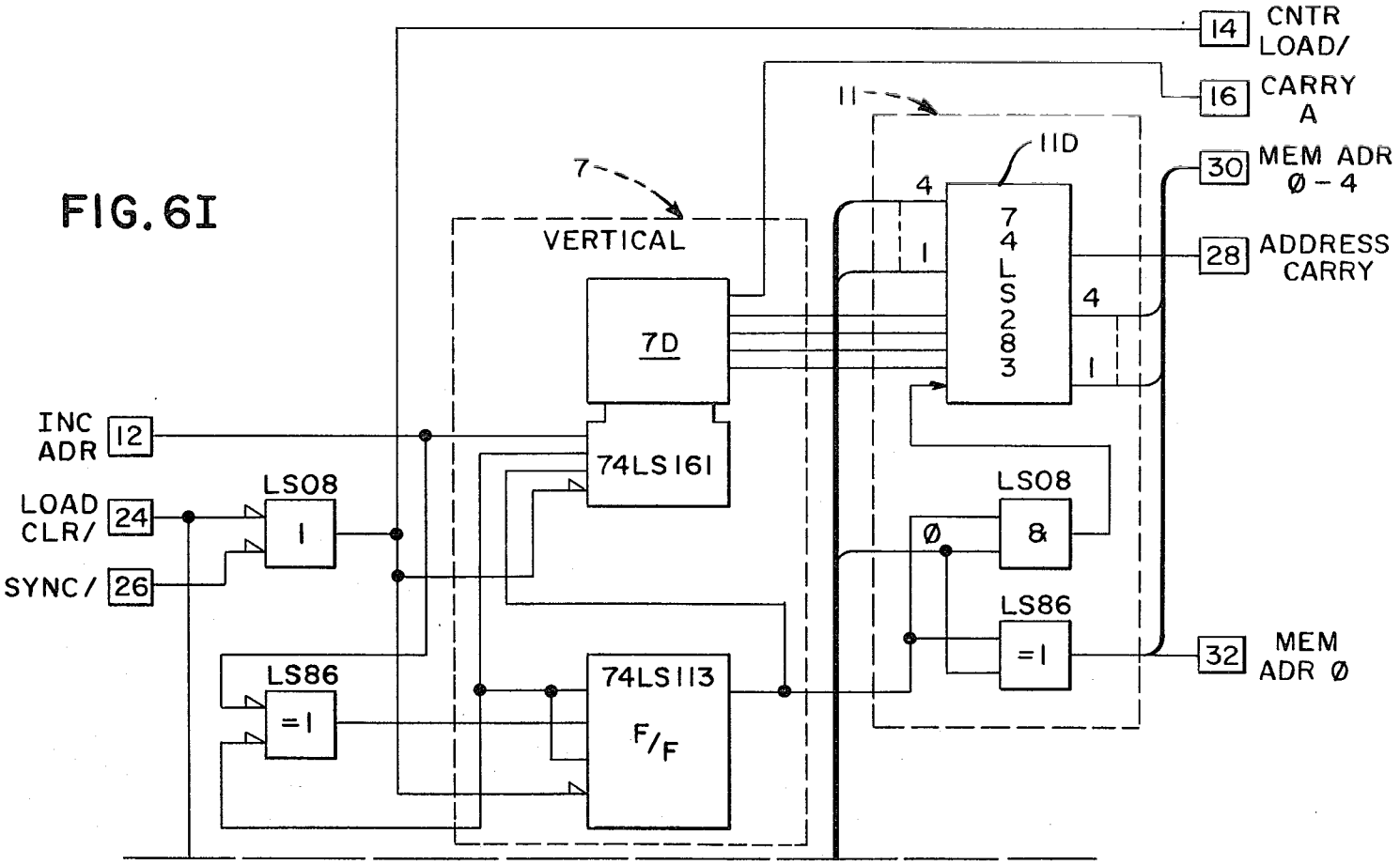
Figure 6J:
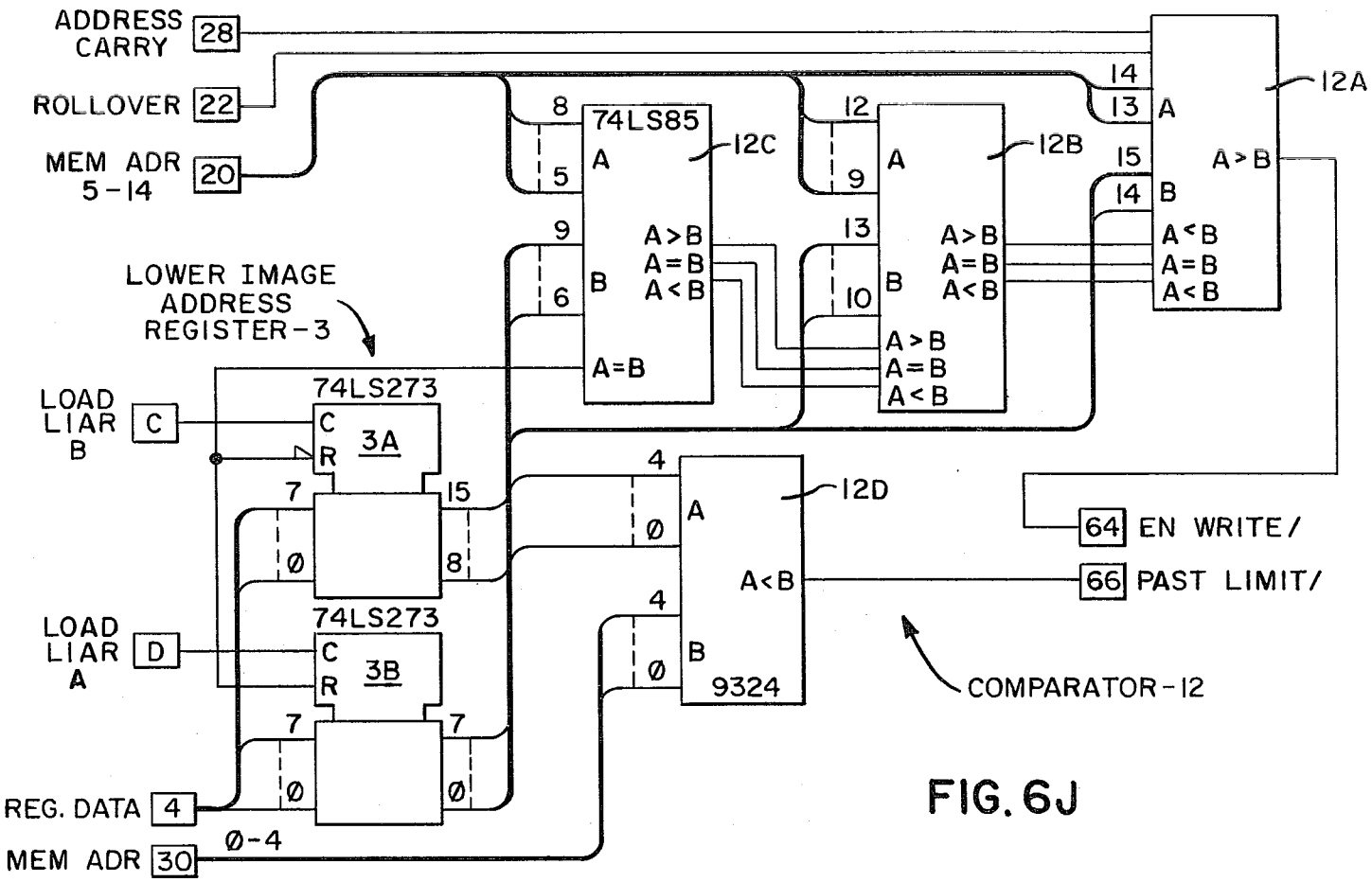
Figure 6K:
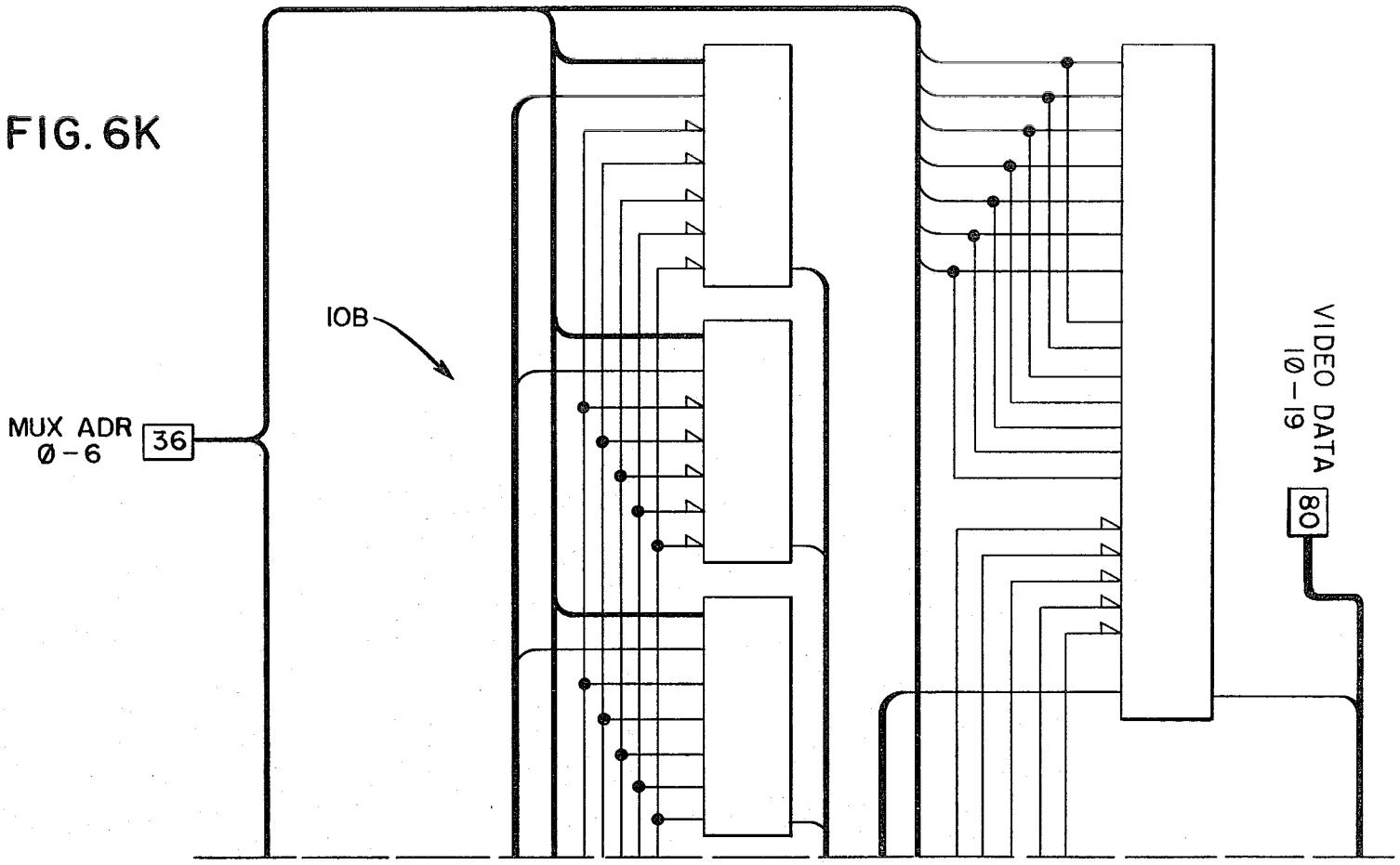
Figure 6L:
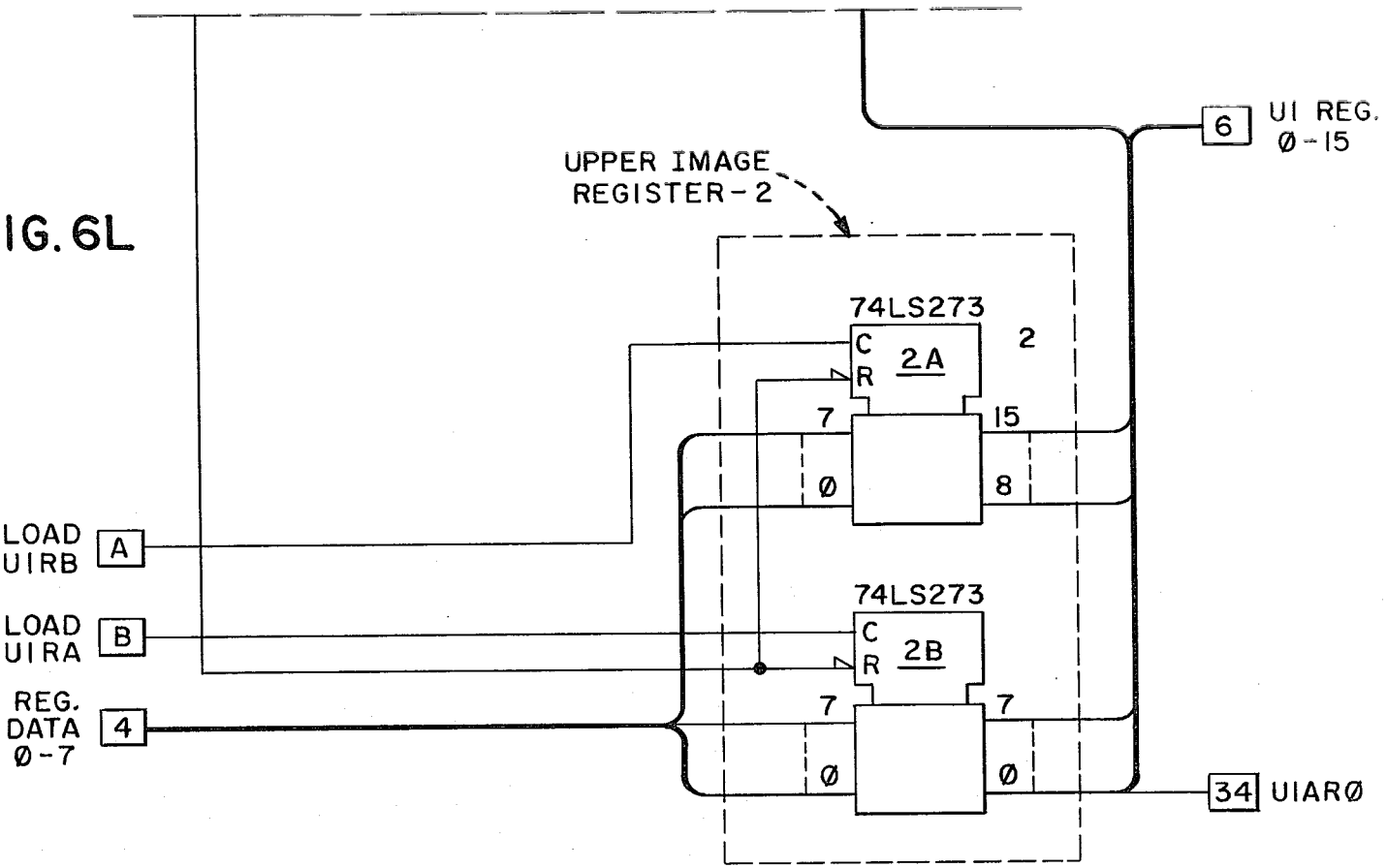
Figure 6M:
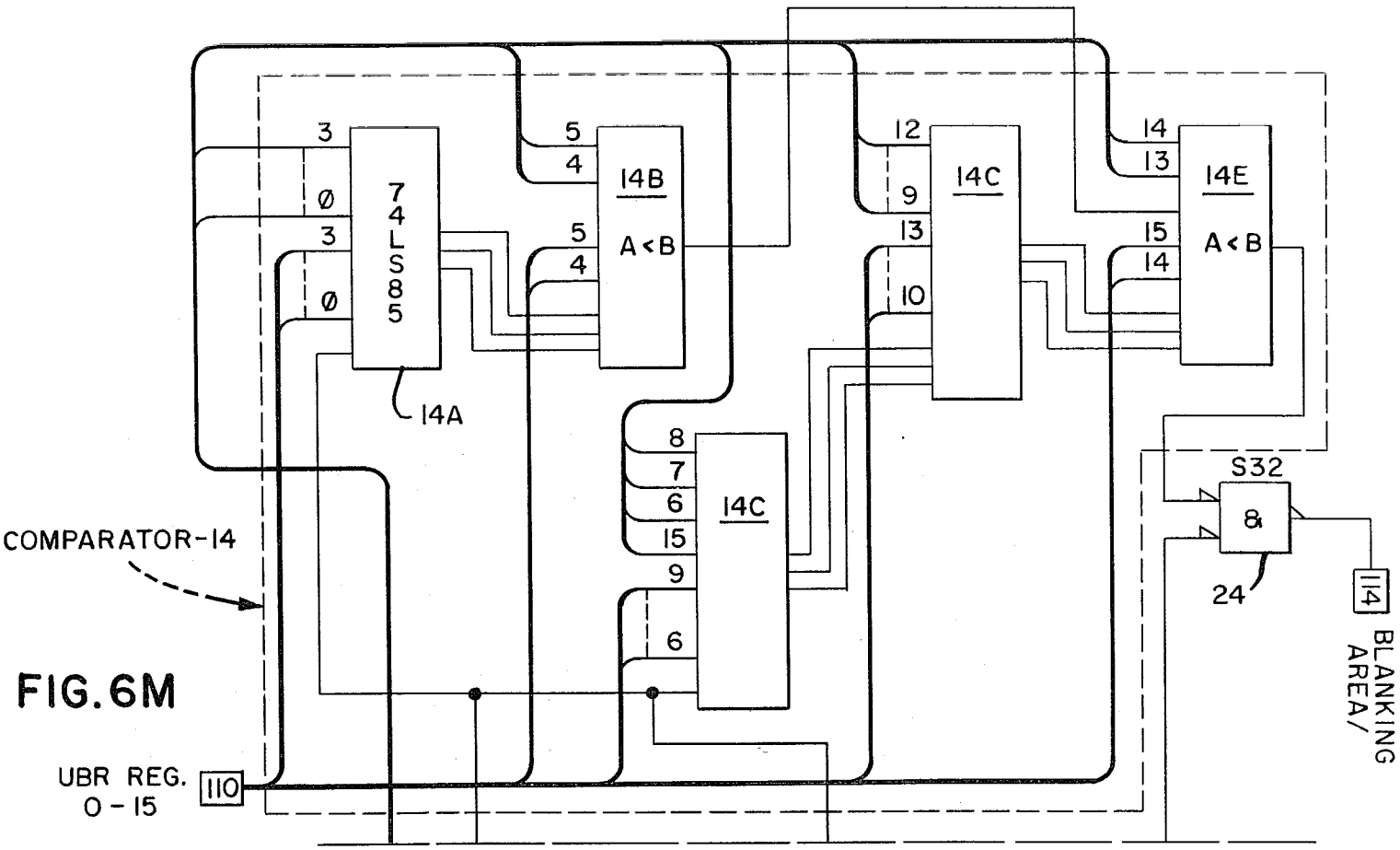
Figure 6N:
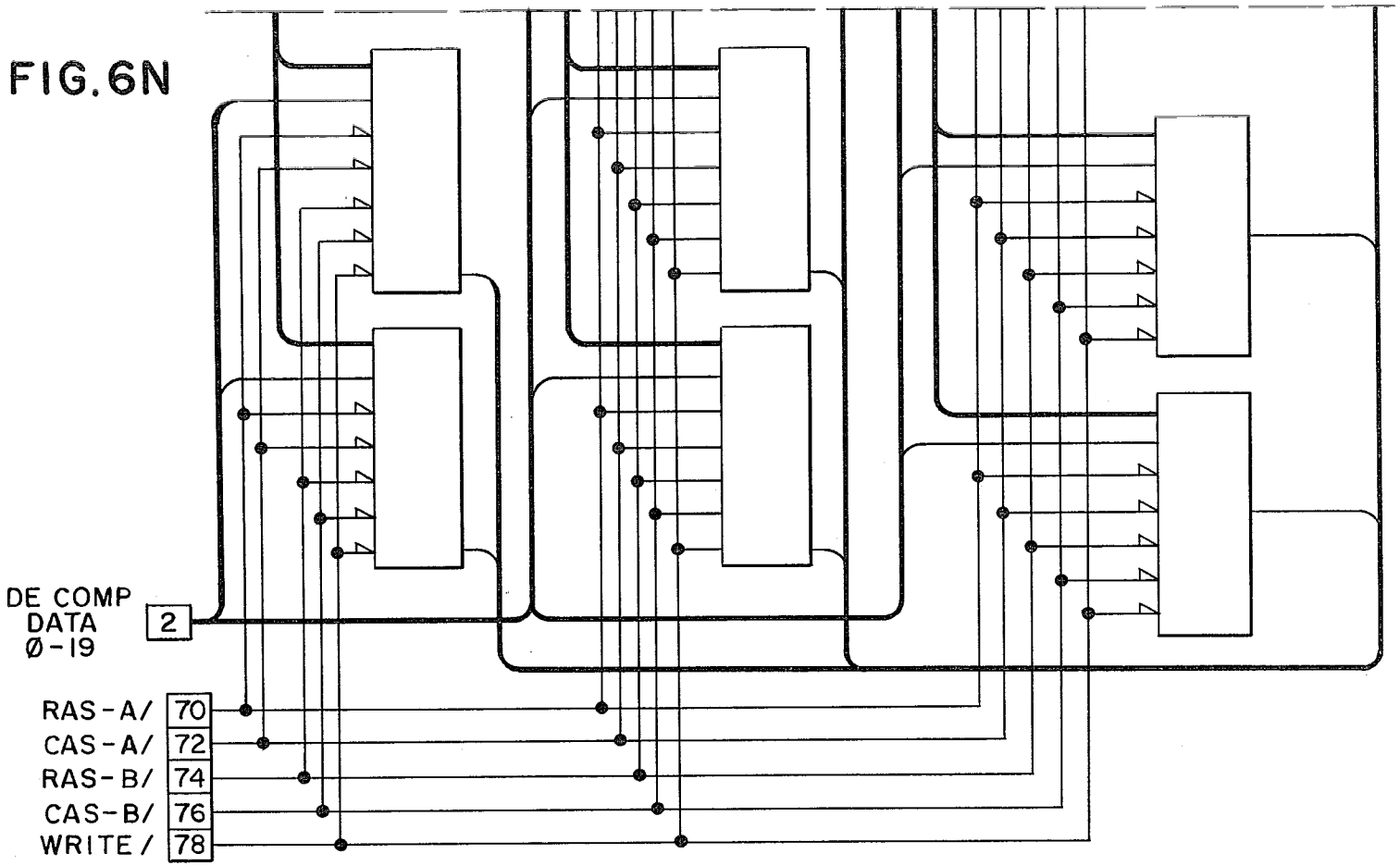
Figure 60:
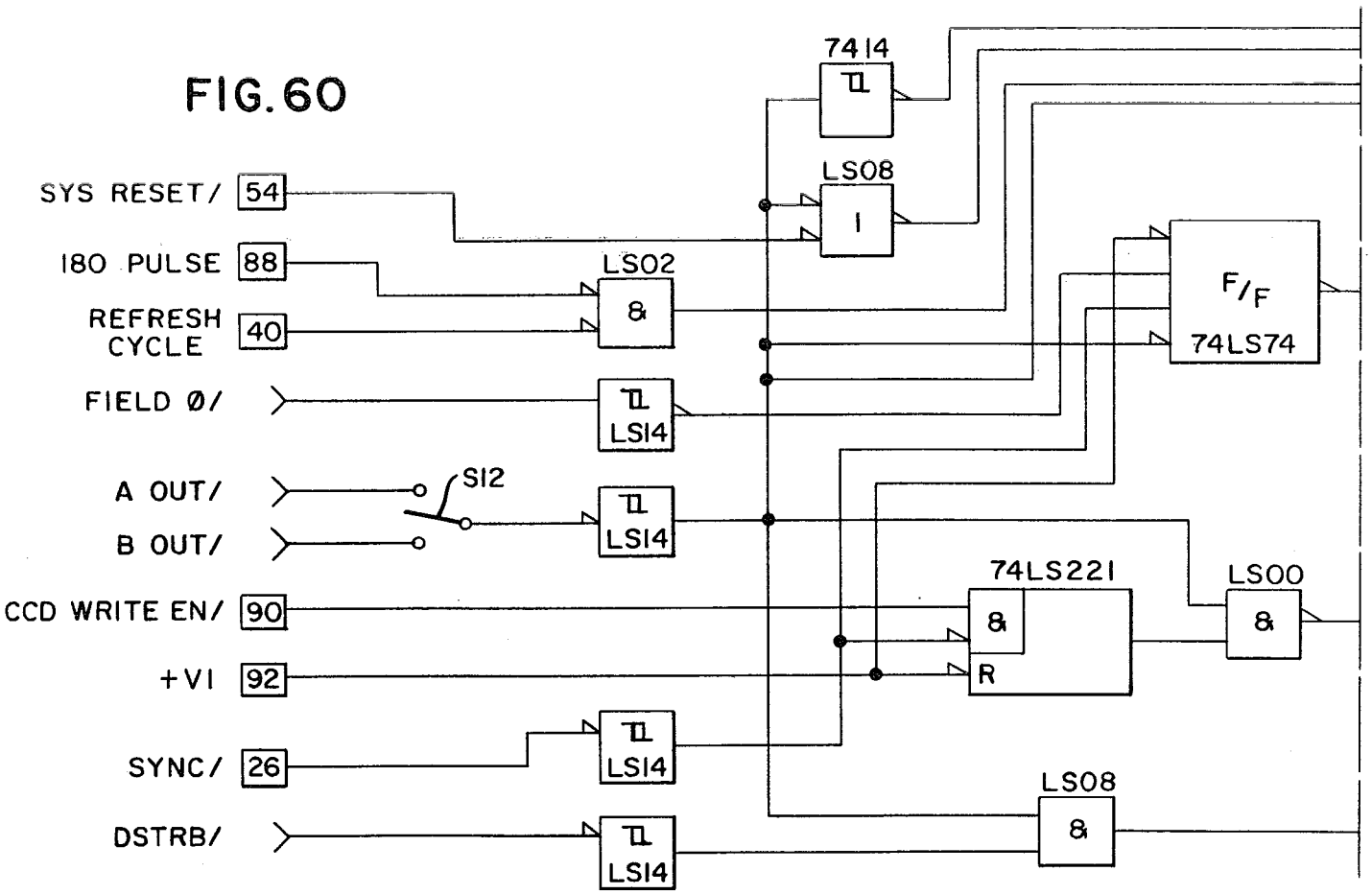
Figure 6P:
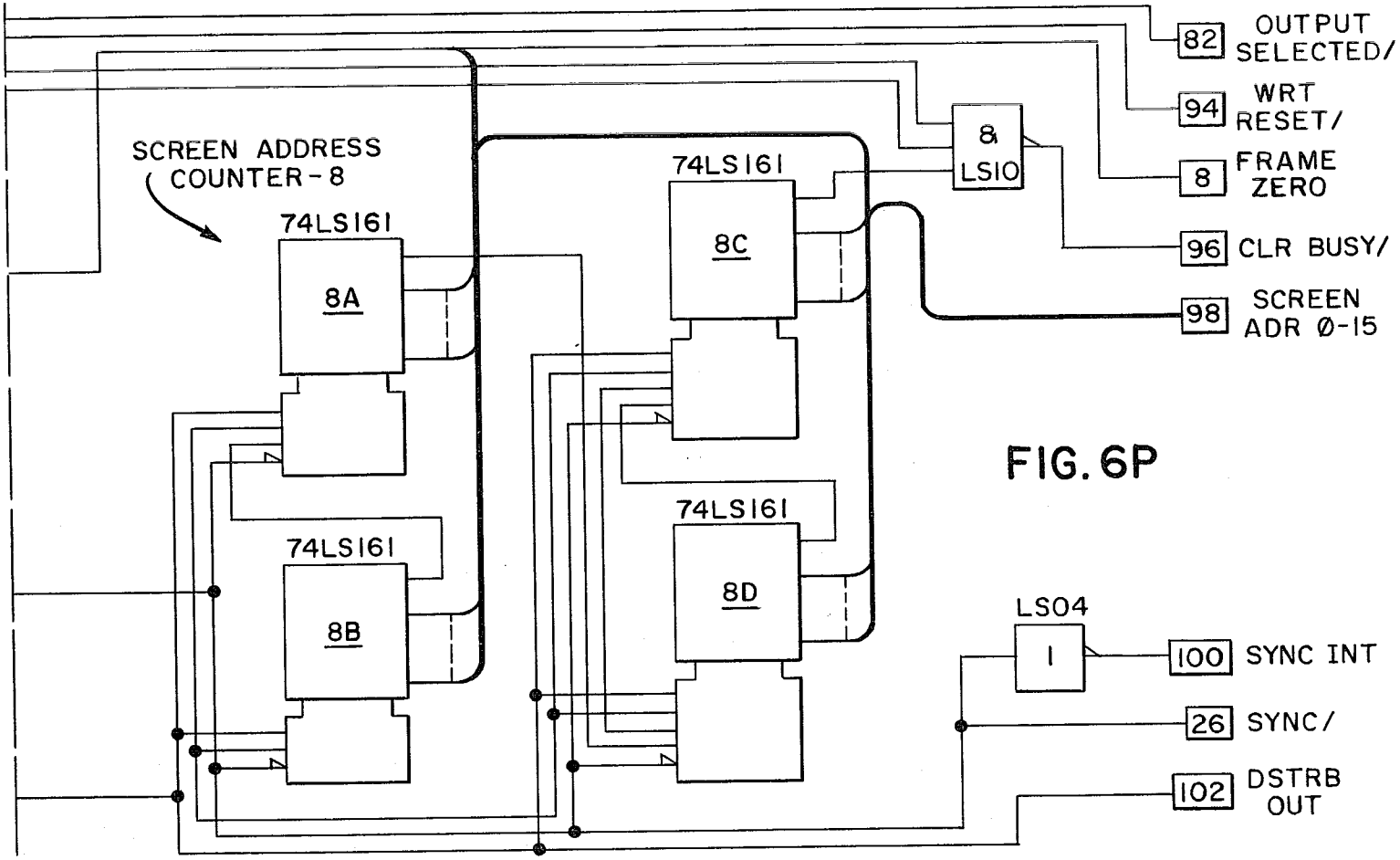
Figure 6Q:
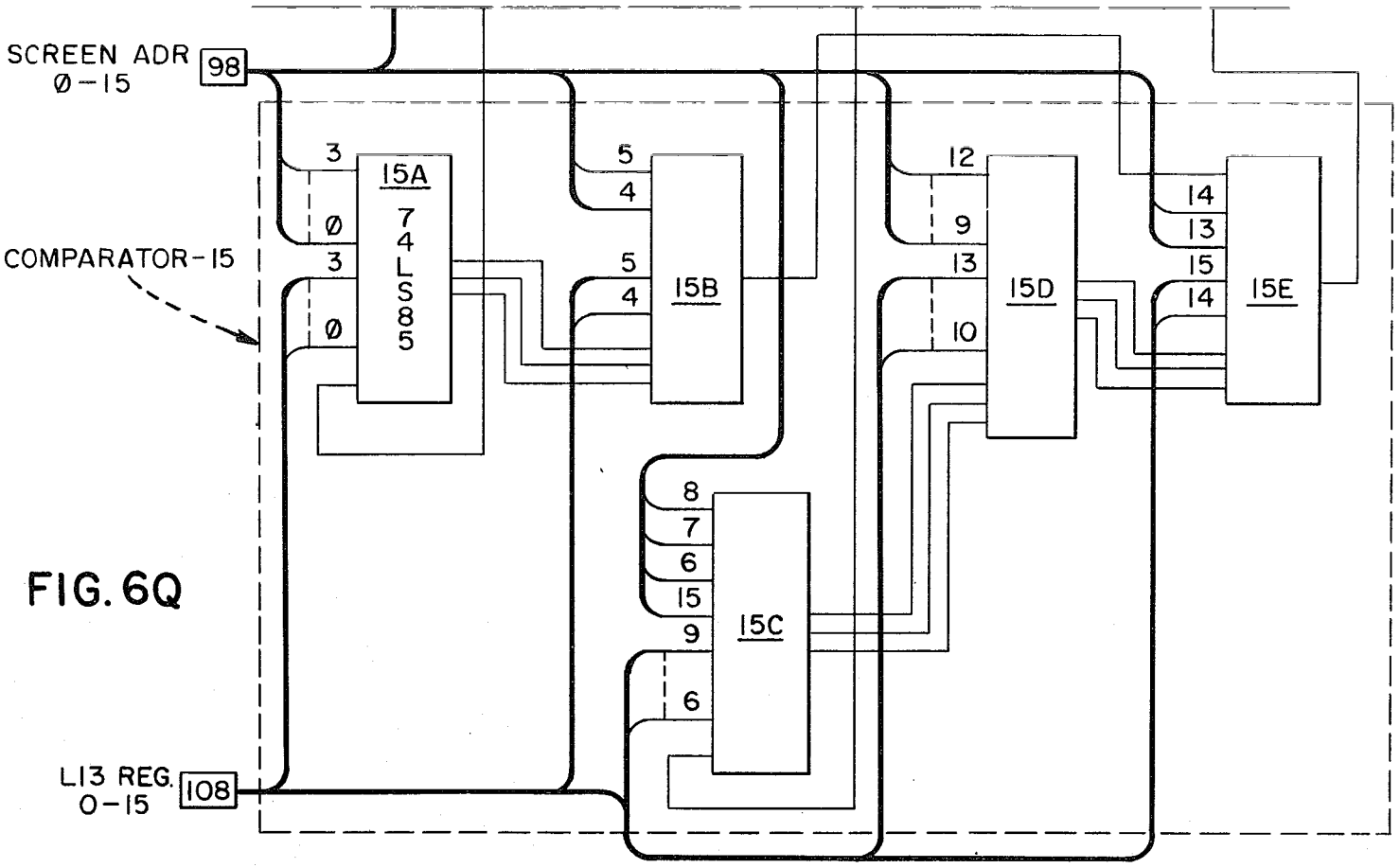
Figure 6R:
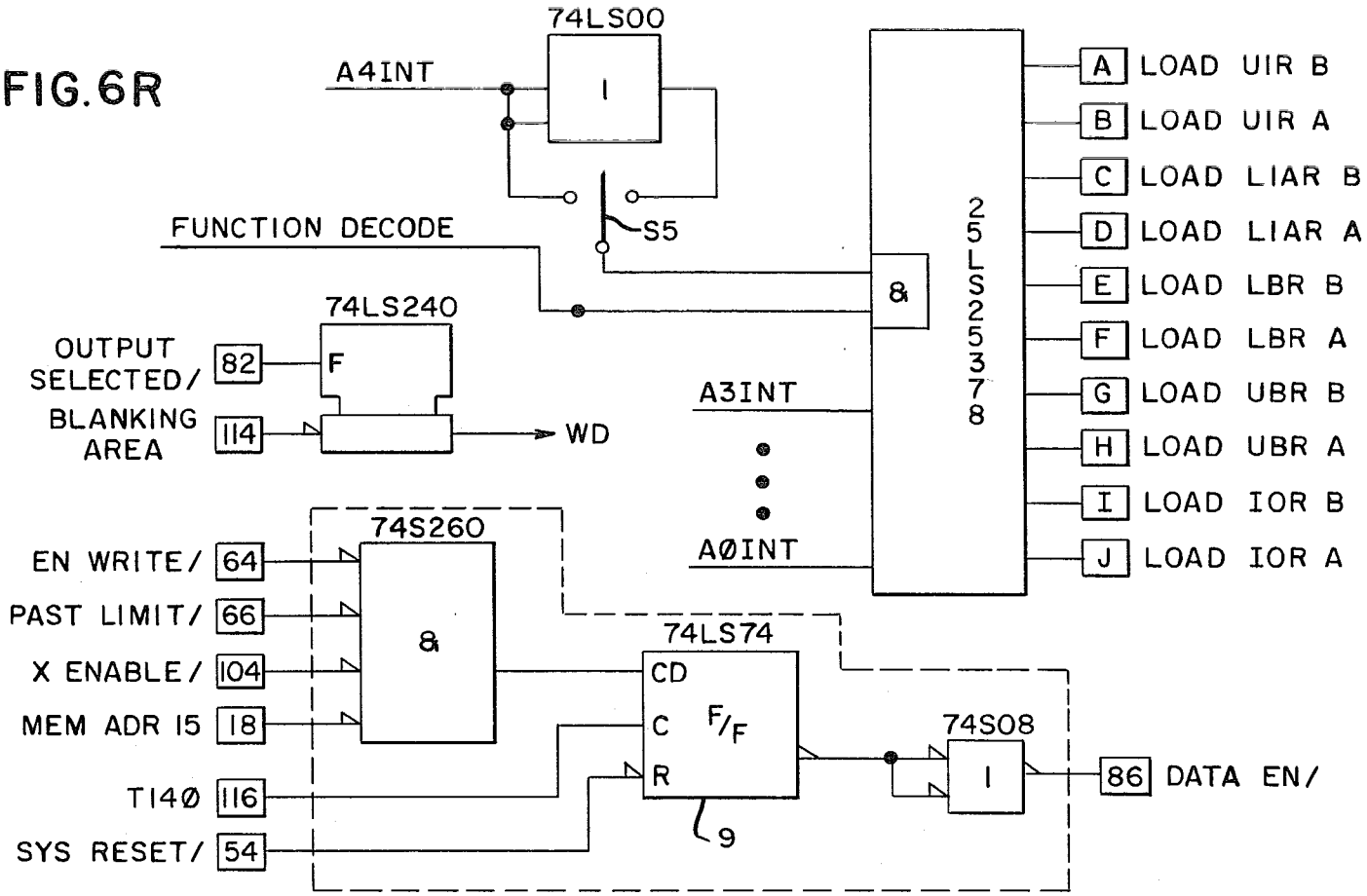
Figure 6S:
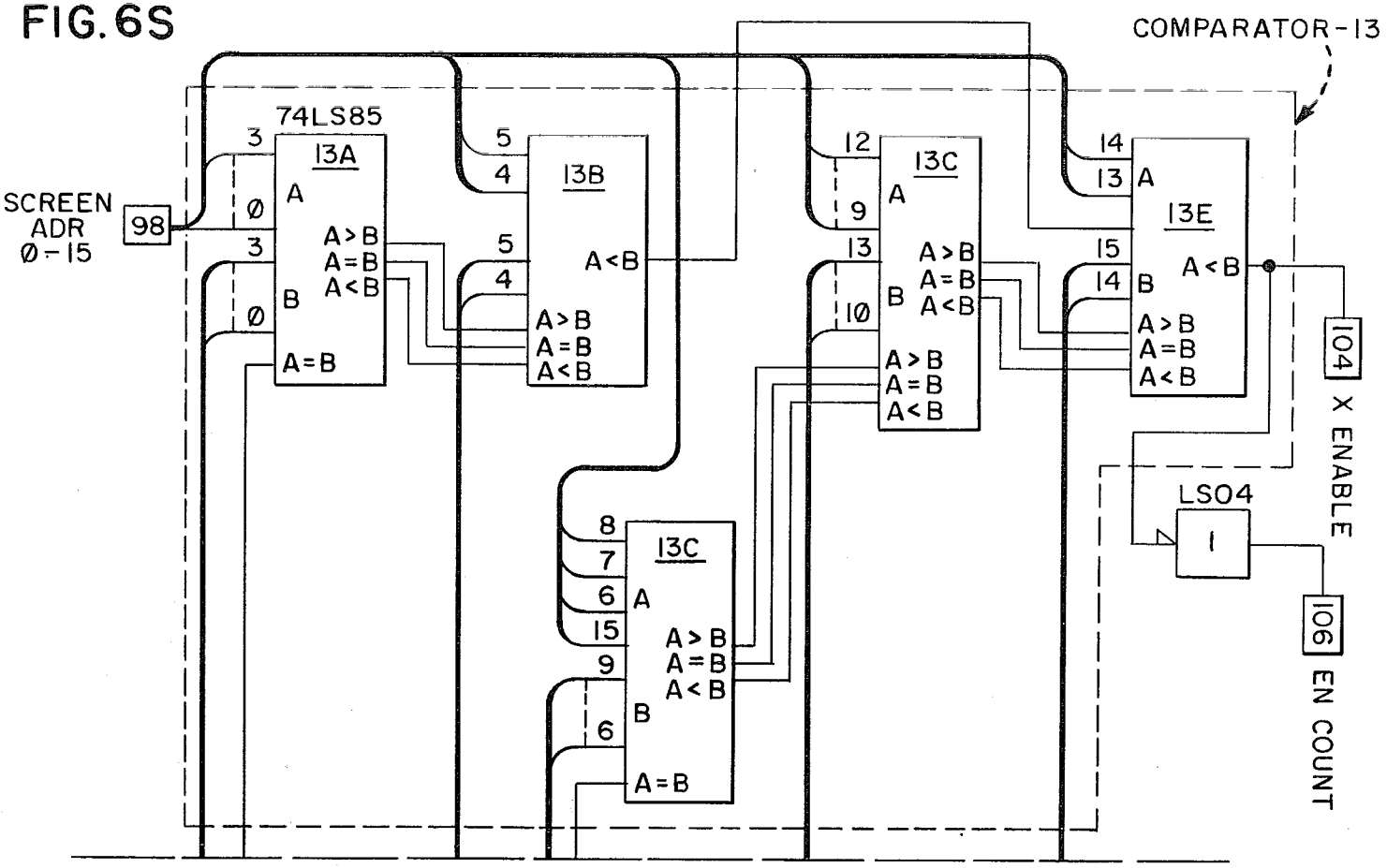
Figure 6T:
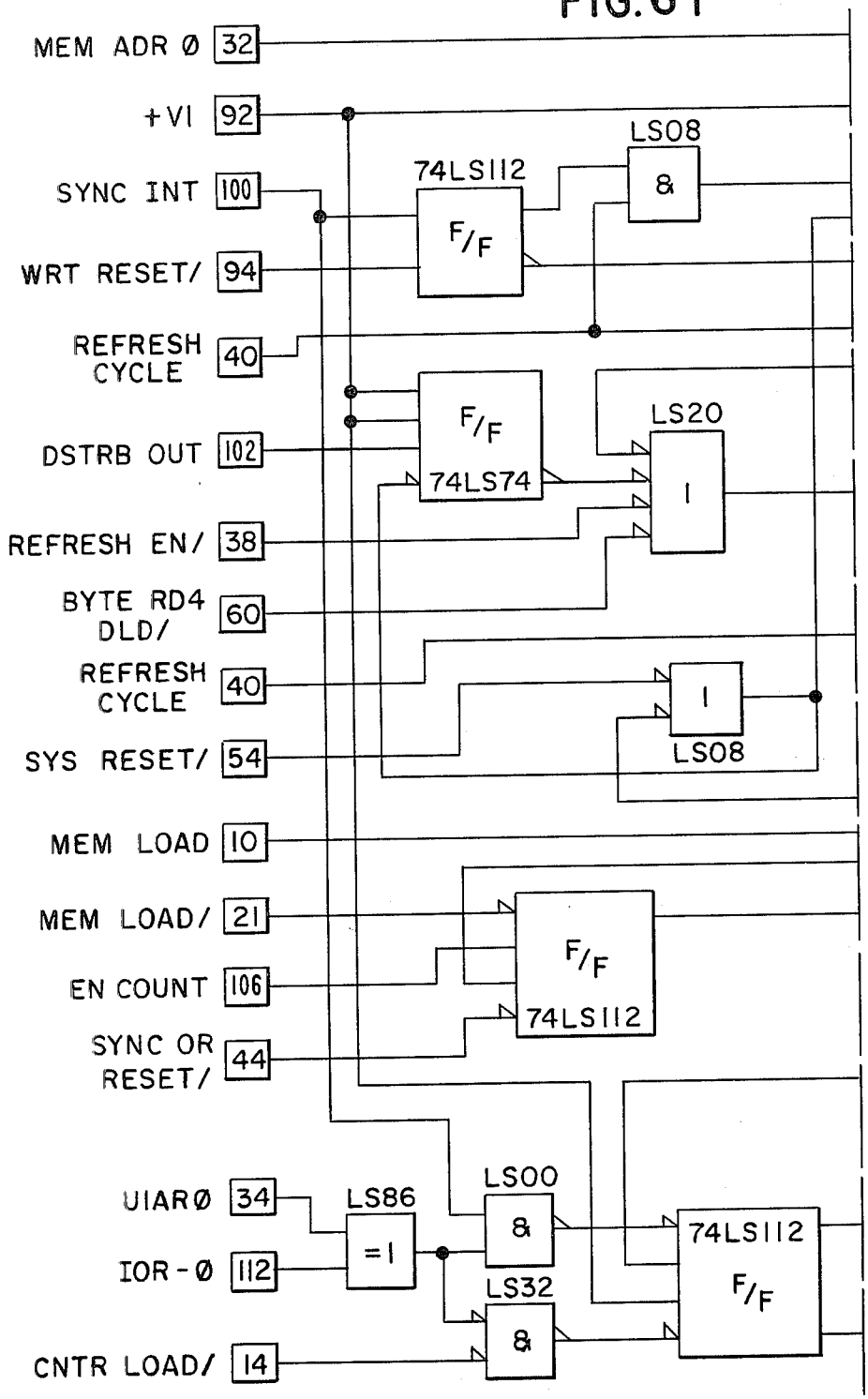
Figure 6U:
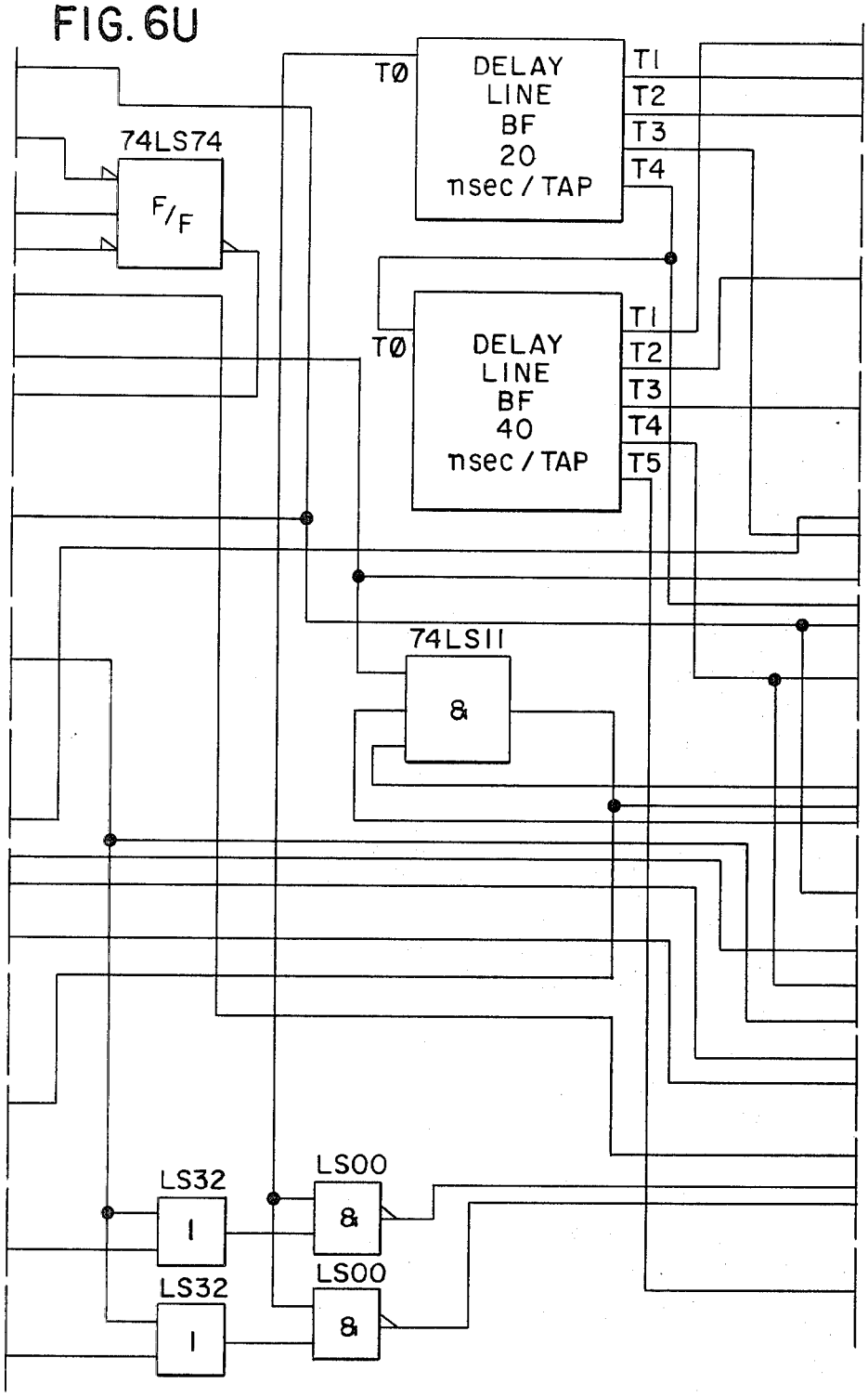
Figure 6V:
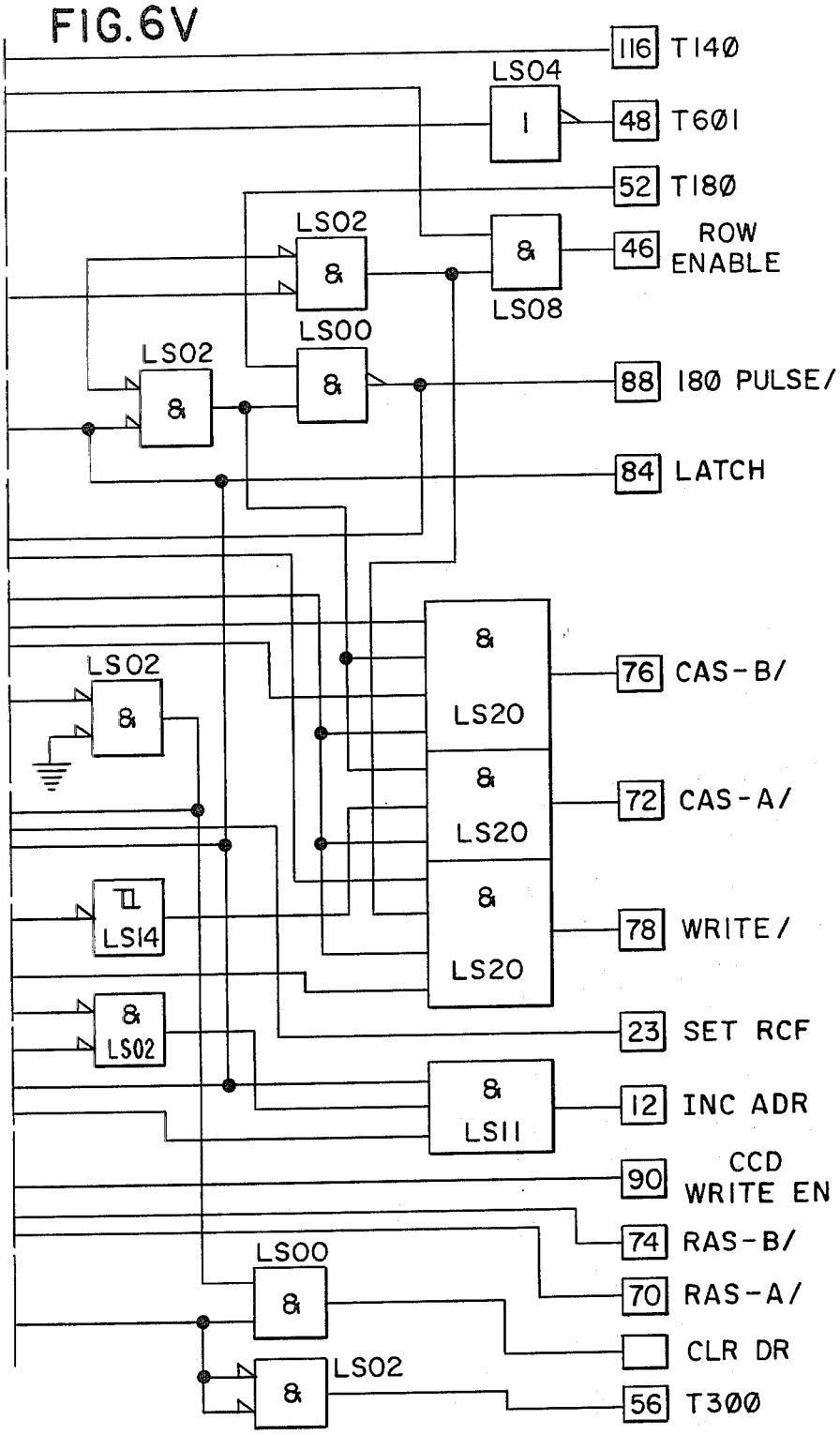
Figure 6W:
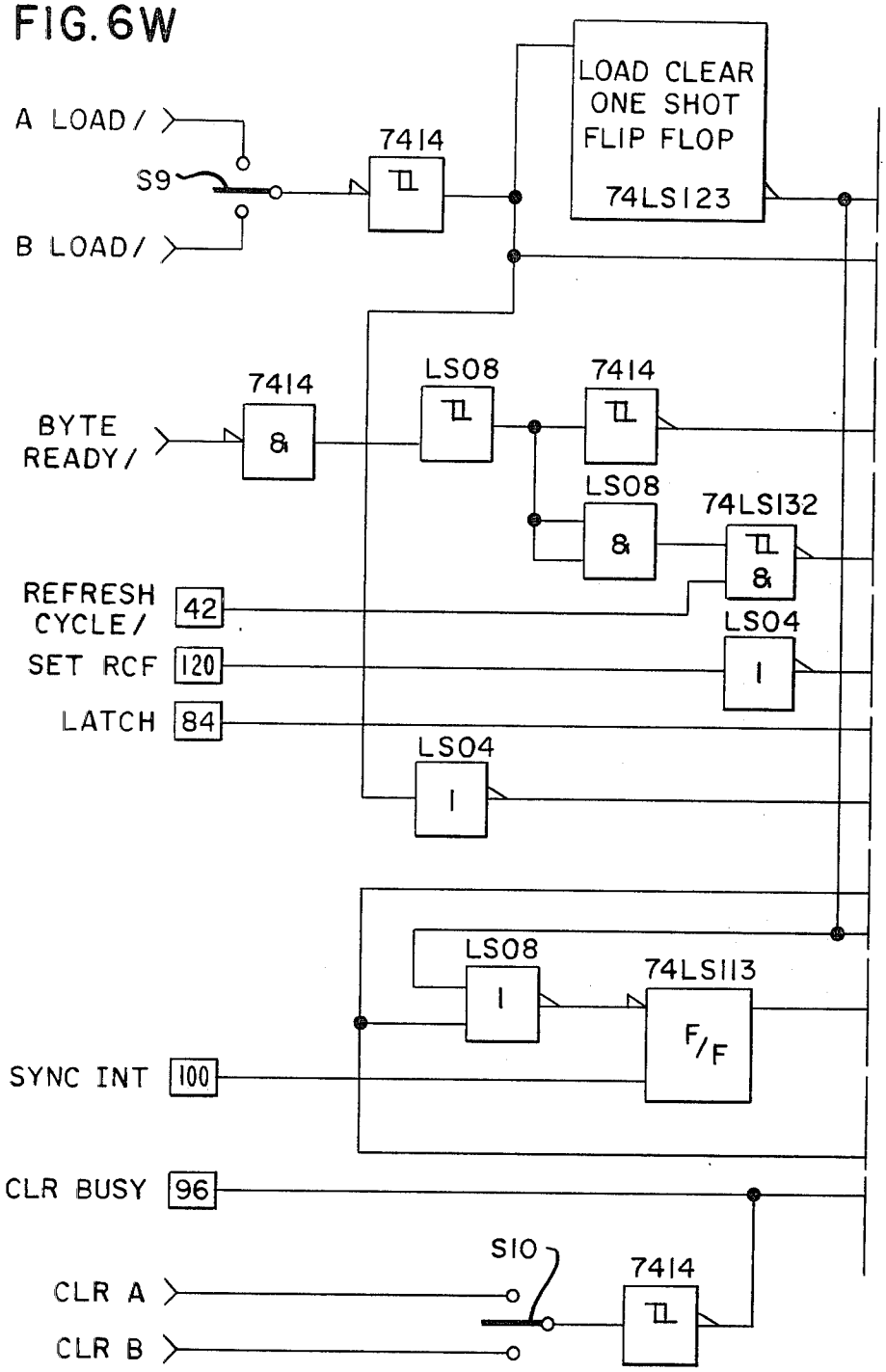
Figure 6X:
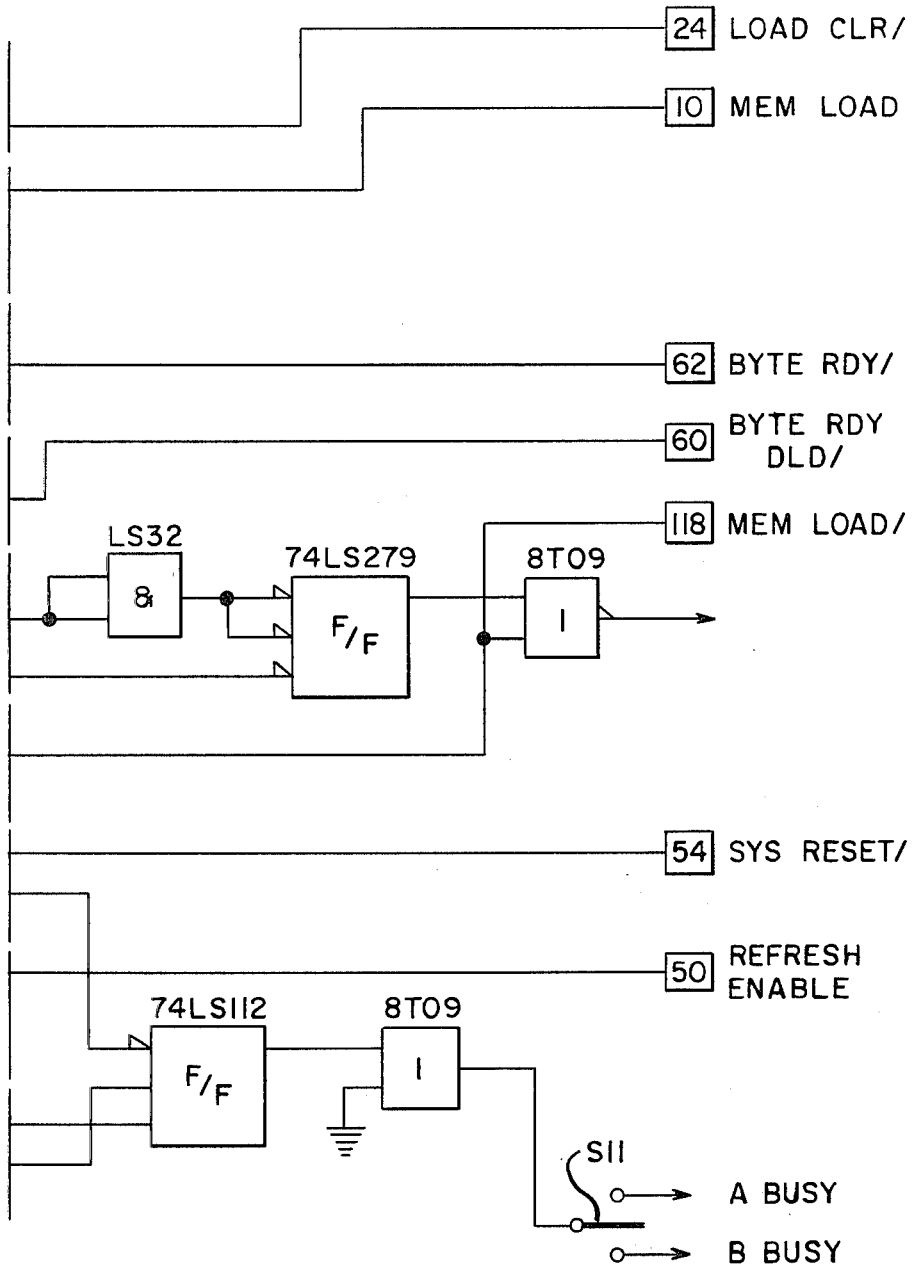
Figure 6Y:
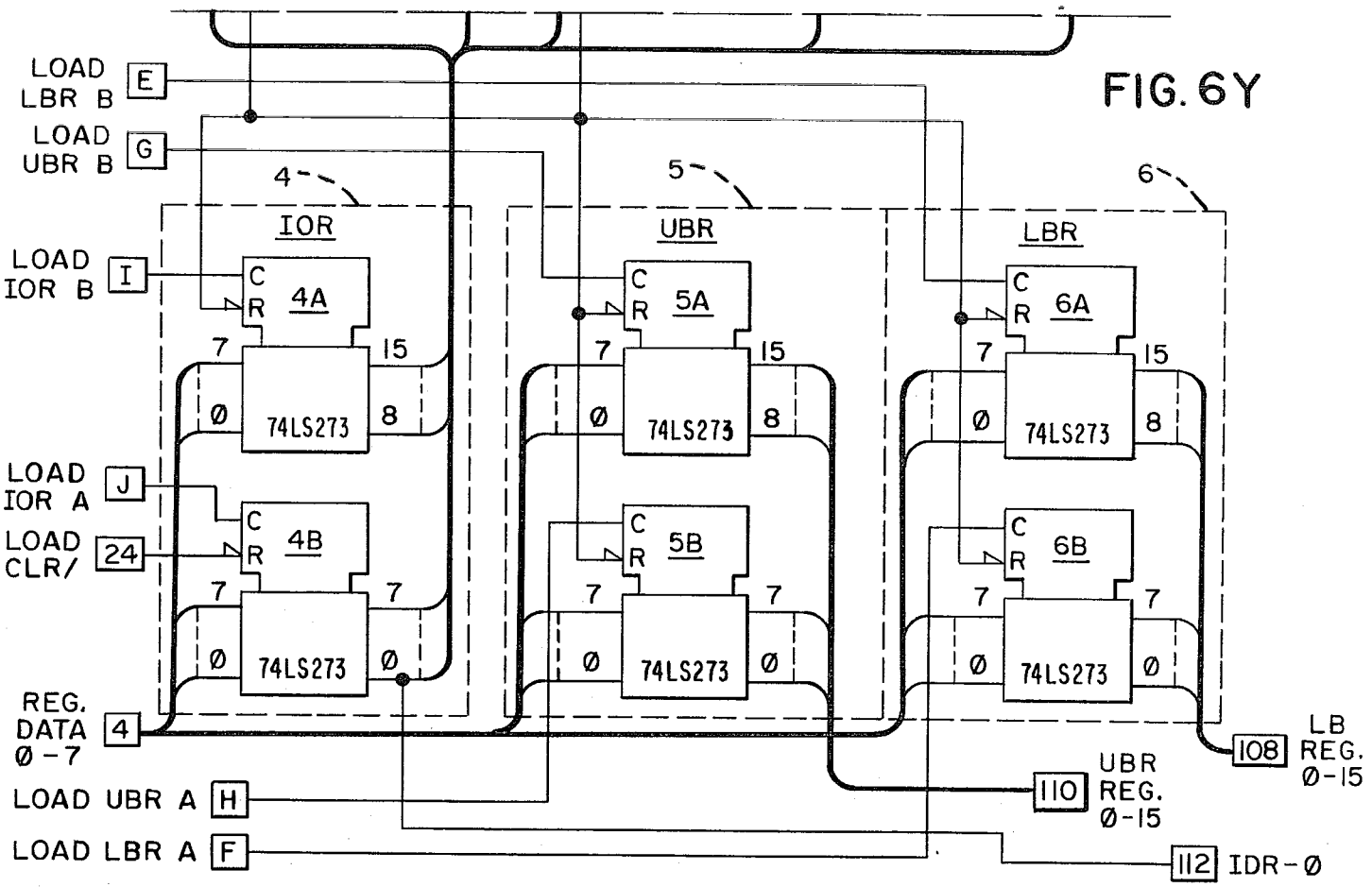

Referring now to FIGS. 6A through 6Y laid out in accordance with the map of FIG. 7 and more specifically to FIG. 6A. In FIG. 6A an image data source 16 comprised of buffers 16A and 16B receives decompressed data bits $\phi$ through 7 from input terminals labeled DC DAT$\phi$ thru DC DAT 7. The buffered outputs are coupled to terminals labeled REG DATA $\phi$–7. The decompressed data bits $\phi$–19 are connected directly from inputs to corresponding output terminals labeled DE COMP $\phi$–19.

Referring now specifically to FIGS. 6F and 6I wherein the upper and lower portions of the memory address counter 7 and the address offset adder 11 are illustrated. The memory address counter 7 is shown comprised of five stages labeled 7A through 7E. Registers 7A through 7C form the horizontal ten bit register and register 7D is the vertical five bit register. The address offset adder 11 is comprised of four summation circuits labeled 11A through 11D. The outputs from counter 7A through 7C are summed by the summers 11A through 11C to provide memory addresses MEM ADR 5 through 14. Note that where line interconnections would further complicate the drawings use has been made of numbers which are block outlined at line conductor continuities with the understanding that like blocked numbers are all interconnected by conductors. A terminal index is provided at the end of the specification. The vertical memory address counter 7D receives as an input an incremental address signal INC ADR on line 22 and a loading signal LOAD CLR/ on line 24. The counter 7D counts and provides an output corresponding to address bits $\phi$ through 4 and then cycles again through bits $\phi$ through 4 while the counter comprised of counter 7A through 7C is counting and providing outputs that are equivalent to address bits 5 through 14. To more generally explain, the counters are working independently of each other but in synchronism. The remaining blocks are logic elements for signal conditioning.

In FIG. 6L the upper image register 2 is shown comprised of two registers labeled 2A and 2B. Eight bits of register data labeled REG DATA $\phi$ through 7 are provided as inputs to each register. The output of registers 2A and 2B form the register bits UI REG $\phi$ through 15 which are coupled to correspondingly labeled inputs of the address offset adder 11.

The memory address multiplexer 18, shown in FIG. 6B, receives as two input signal groups the memory address bits $\phi$ through 4 and the memory address bits 5 through 14. The multiplexer 18 alternately samples these input signal groups to provide the memory addresses $\phi$ through 6. The multiplexing rate is controlled by the signal appearing at the ROW EN labeled input.

The remainder of the circuitry shown in FIG. 6B and in FIG. 6G is utilized to refresh the memory 10 if a dynamic type memory such as an MOS memory is utilized as was the case in the preferred embodiment of the invention.

The memory 10 is shown in two sections (memory boards) labeled 10A and 10B in FIGS. 6C, 6H and FIGS. 6K, 6N, respectively. Each memory section is identical to the other wherein ten random access memory elements 10C are shown. The memory element 10C' is shown in expanded view to more clearly illustrate the interconnections to a standard random access memory (RAM) element of, for example, the type manufactured by Mostek under part no. 4332-2. The video data bits $\phi$ through 9 appear at the output terminal 68 of the memory elements in 10A and the video data bits 10 through 19 appear at the output terminal 68 of the memory elements in 10D. The video data bits $\phi$ through 19 are directed to three video data registers 30A, B, and C, which for purposes of this disclosure will be considered as part of the MUX 1. The MUX 1 is additionally comprised of five data buffers 31A through 31E each receiving the output from an associated video data register. A multiplexing control signal is applied to terminal F of the registers and provides at its outputs the information data bits labeled IDB$\phi$ through IDB19. The switches S3 and S4 at the F inputs to data bus buffers 31 and video data registers 30 select whether the blanking action will cause a dark or a light background to appear on the CRT display. The IDB bits are provided in parallel at the output of the multiplexer 1 and must be converted to serial format for CRT display purposes. This is accomplished by directing the parallel output bits to a refresh buffer 20. The schematic of the buffer is not included herein in order to simplify the description. The output of the refresh buffer 20 is serial in nature and is directed to the driving circuits of the CRT display. Parallel-to-serial buffers are well known in the art.

Referring now specifically to FIG. 6J the lower image address register 3 is comprised of two registers 3A and 3B each register receiving the register data bits $\phi$ through 7 as inputs under the control of the signals LIAR B and load LIAR A which are applied to the inputs labeled C and D, respectively. The first five bits $\phi$ through 4 from the lower image address register are used to fix the lower vertical starting address of memory readout with the second group of bits 5 through 15 setting the lower horizontal starting address. The outputs from the lower image address register are sent to the comparator 12 which is comprised of four compare sections labeled 12A through 12D. The comparator 12 also receives as comparing inputs the memory addresses 5 through 14 from the memory address offset adder 11. When coincidence occurs between all inputs and enable write signal EN WRITE is provided at the output of comparator 12A.

Referring now to FIGS. 6O and 6P, the screen address counter 8 is comprised of four counter sections labeled 8A through 8D, and associated logic circuitry. The major input to the screen address counters is the CRT synchronizing signal SYNC/. The outputs from the screen address counter 8 are divided into two groups, the first being six bits, bits $\phi$ through 5 corresponding to the vertical address on the CRT display (screen) and the second being 10 bits, bits 6 through 15 corresponding to the horizontal address on the CRT display. These bits are directed to the input of comparator 13 (shown in FIG. 6S), comparator 14 (shown in FIG. 6M) and comparator 15 (shown in FIG. 6Q). Each of the comparators is identical in construction. The switch S12 operates to identify the memory board as being either A or B (two memory boards may be used in a system to increase throughput).

Referring now specifically to FIG. 6Y the image origin register 4 (IOR) is shown comprised of two register sections 4A and 4B each receiving the register data bits $\phi$ through 7 as inputs along with the control signal LOAD letter IOR A and LOAD letter IOR B respectively. Bits $\phi$ through 5 from the register 4 are directed to comparator comparing sections 13A and 13B of comparator 13. The first six bits, $\phi$ to 5, correspond to the vertical address position of the image to be displayed on the screen of CRT 21. The next 10 bits, bits 6 through 15 are directed to comparator sections 13C through 13E and represent the horizontal address of the image to be displayed on the CRT diaplay 21.

The upper blanking register 5 (UBR) is shown comprised of two register sections 5A and 5B. The upper blanking register 5 receives as inputs the register data bits $\phi$ through 7 and provides as an output UBR REG bits $\phi$ through 15 to comparator 14.

Comparator 14 shown in FIG. 6M is comprised of five comparator sections labeled 14A through 14E. The UBR register bits $\phi$ through 15 are applied as indicated, to comparison inputs of comparators 14A through 14E the remaining inputs being derived from the screen address bits $\phi$ through 15 emanating from the screen address counter 8.

A lower blanking register 6 comprised of registers 6A and 6B receives as its inputs the register data bits $\phi$ through 7 and provides as an output the LB REG bits $\phi$ through 15 to the inputs of comparator 15 (FIG. 6Q). The upper and lower blanking registers are connected to provide blanking signals whenever data signals are not being transmitted.

The AND gate 9 illustrated in FIG. 6R receives as inputs; the signal from comparator 12, AND gate 22, a carry signal from the address offset adder 11, and upon coincidence of each of the received signals provides a DATA EN/ signal to the multiplexer 1. The switch S5 operates to differentiate the load commands for board A from board B.

In FIGS. 6T, 6U and 6V there is disclosed the timing circuits for operation of the memory 10. FIGS. 6W and 6X disclose the circuitry for interfacing and for the loading of the memory. The switches S9, S10 and S11 operate to identify the A and B memory boards.

Although the invention has been described and illustrated in detail, it is to be clearly understood that the same is by way of illustration and example only and is not to be taken by way of limitation, the spirit and scope of the invention being limited only by the terms of the appended claims.

TERMINAL INDEX

| | | | |
|---|---|---|---|
| 2 | DE COMP $\phi$-19 | A | LOAD UIR B |
| 4 | REG. DATA $\phi$-7 | B | LOAD UIR A |
| 6 | UI REG. $\phi$-15 | C | LOAD LIAR B |
| 8 | FRAME ZERO | D | LOAD LIAR A |
| 10 | MEM. LOAD | E | LOAD LBR B |
| 12 | INC ADR | F | LOAD LBR A |
| 14 | CNTR LOAD/ | G | LOAD URB B |
| 16 | CARRY A | H | LOAD UBR A |
| 18 | MEM ADR 15 | I | LOAD IOR B |
| 20 | MEM ADR 5-14 | J | LOAD IOR A |
| 22 | ROLLOVER | | |
| 24 | LOAD CLR/ | | |
| 26 | SYNC/ | | |
| 28 | ADDRESS CARRY | | |
| 30 | MEM ADR $\phi$-4 | | |
| 32 | MEM ADR $\phi$ | | |
| 34 | UIAR $\phi$ | | |
| 36 | MUX ADR $\phi$-6 | | |
| 38 | REFRESH EN/ | | |
| 40 | REFRESH CYCLE | | |
| 42 | REFRESH CYCLE/ | | |
| 44 | SYNC OR RESET/ | | |
| 46 | ROW ENABLE | | |
| 48 | TG$\phi$1 | | |
| 50 | REFRESH ENABLE | | |
| 52 | T18$\phi$ | | |
| 54 | SYS. RESET/ | | |

-continued

| TERMINAL INDEX | |
|---|---|
| 56 | T3ϕϕ |
| 58 | T3ϕϕ PULSE |
| 60 | BYTE RDY OLD/ |
| 62 | BYTE RDY/ |
| 64 | EN WRITE/ |
| 66 | PAST LIMIT/ |
| 68 | VIDEO DATA ϕ-19 |
| 70 | RAS-A/ |
| 72 | CAS-A/ |
| 74 | RAS-B/ |
| 76 | CAS-B/ |
| 78 | WRITE/ |
| 80 | VIDEO DATA 1ϕ-19 |
| 82 | OUTPUT SELECTED/ |
| 84 | LATCH |
| 86 | DATA EN/ |
| 88 | 180 PULSE/ |
| 90 | WRITE EN/ |
| 92 | +V/ |
| 94 | WRT RESET/ |
| 96 | CLR BUSY |
| 98 | SCREEN ADR ϕ-15 |
| 100 | SYNC INT |
| 102 | DSTRB OUT |
| 104 | X ENABLE/ |
| 106 | EN COUNT |
| 108 | LB REG. ϕ-15 |
| 110 | UBR REG. ϕ-15 |
| 112 | IOR-ϕ |
| 114 | BLANKING AREA/ |
| 116 | T14ϕ |
| 118 | MEM LOAD/ |
| 120 | SET RCF |

| PARTS LIST | | | |
|---|---|---|---|
| 3242 MUX | - IN | 74 LS113 | - TI |
| 74 LS112 | - TI | 74 LS273 | - TI |
| 74 LS74 | - TI | 25LS2537 DCDR | - AMD |
| 74 LS20 | - TI | 74 S260 | - TI |
| 74 LS08 | - TI | 9324 | - AMD |
| 74 LS86 | - TI | 74 LS374 | - TI |
| 74 LS00 | - TI | 74 LS240 | - TI |
| 74 LS32 | - TI | MEMORY DELAYS | - BF |
| 74 S11 | - TI | | |
| 74 LS02 | - TI | | |
| 74 LS14 | - TI | | |
| 74 LS04 | - TI | | |
| 7414 | - TI | | |
| 74 LS221 | - TI | | |
| 74 LS161 | - TI | | |
| 74 LS85 | - TI | | |
| 74 LS244 | - TI | | |
| 74 LS283 | - TI | | |
| 74 LS191 | - TI | | |
| 74132 | - TI | | |
| 74 LS10 | - TI | | |
| 74192 | - TI | | |
| 74 LS123 | - TI | | |
| 74 LS79 | - TI | | |

IN = Intel
TI = Texas Instruments
AMD = Advanced Micro Devices
BF = Bel Fuse Inc.

I claim:

1. An image formatting apparatus for a visual display comprising:

memory means for storing image data at addressable locations;

display means for displaying image data;

addressing means for generating sequentially and periodically all of the memory addresses of said memory means;

image means for providing memory addresses at which image data is to be read out;

comparing means for comparing the memory address generated by said addressing means with the addresses provided by said image means and for providing address signals to said memory means when a correspondence exists;

blanking means for providing blanking signals to said display means; and means interposed between said display means, said blanking means and said memory means for controlling the receipt of blanking signals and image signals by said display means to provide a desired image format.

2. An image formatting apparatus according to claim 1 is comprised of:

an upper blanking means for controlling the upper vertical and horizontal positions of blanking on said display means; and a lower blanking means for selecting the lower vertical and horizontal positions of blanking on said display means.

3. The image formatting apparatus of claim 1 wherein said upper and said lower blanking means are registers having settable outputs corresponding to display positions on said display means.

4. An image formatting apparatus for a visual display according to claim 5 and further comprising:

origin means for generating an origin signal corresponding to the display position on said display means where imaging is to commence; and comparator means for comparing the origin signal from said origin means with the position of scan on said display means and for controlling said selector means to connect said image means to said display means when coincidence is achieved.

5. An image formatting apparatus according to claim 1 and further comprising:

screen addressing means for generating sequentially and periodically all of the display positions of said display means;

origin means for generating an origin address corresponding to selected display positions of said display means; and comparator means for controlling the presentation of image data and blanking signals to said display means in accordance with the existence of a coincidence between selected origin address and display positions.

* * * * *

UNITED STATES PATENT AND TRADEMARK OFFICE

CERTIFICATE OF CORRECTION

PATENT NO. : 4,352,100

DATED : September 28, 1982

INVENTOR(S) : Stephen B. O'Connell

It is certified that error appears in the above—identified patent and that said Letters Patent is hereby corrected as shown below:

Claim 4, column 10, line 37, delete "5" and insert therefor --1--.

Signed and Sealed this

*Third* Day of *May 1983*

[SEAL]

*Attest:*

GERALD J. MOSSINGHOFF

*Attesting Officer*

*Commissioner of Patents and Trademarks*